US008433233B2

(12) United States Patent
Saito

(10) Patent No.: US 8,433,233 B2
(45) Date of Patent: Apr. 30, 2013

(54) IMAGE FORMING APPARATUS AND SHEET CONVEYING METHOD THAT CORRECT FOR SKEW OF SHEET CONVEYED TO IMAGE FORMING UNIT

(75) Inventor: Hiroshi Saito, Kashiwa (JP)

(73) Assignee: Canon Kabushiki Kaisha (JP)

( * ) Notice: Subject to any disclaimer, the term of this patent is extended or adjusted under 35 U.S.C. 154(b) by 352 days.

(21) Appl. No.: 12/897,204

(22) Filed: Oct. 4, 2010

(65) Prior Publication Data

US 2011/0081181 A1 Apr. 7, 2011

(30) Foreign Application Priority Data

Oct. 5, 2009 (JP) ..... 2009-231326

(51) Int. Cl.
*G03G 15/00* (2006.01)

(52) U.S. Cl.
USPC ..... 399/395; 399/401

(58) Field of Classification Search ..... 399/395, 399/394, 396, 401; 271/10.12, 227, 65
See application file for complete search history.

(56) References Cited

U.S. PATENT DOCUMENTS

2006/0165452 A1* 7/2006 Takiguchi et al. ..... 399/394
2007/0273090 A1* 11/2007 Kawaguchi ..... 271/226
2009/0162119 A1* 6/2009 Prabhat et al. ..... 399/395

FOREIGN PATENT DOCUMENTS

JP 10-032682 A 2/1998

* cited by examiner

*Primary Examiner* — Judy Nguyen
*Assistant Examiner* — Blake A Tankersley
(74) *Attorney, Agent, or Firm* — Rossi, Kimms & McDowell LLP

(57) ABSTRACT

An image forming apparatus that can reliably correct for skew of a sheet being conveyed. The amount of skew of the sheet is detected, and the amount of toner used for an image formed on a first surface of the sheet is determined. When the sheet with the image formed on the first surface thereof is conveyed so as to form an image on a second surface of the sheet, a skew correction roller unit is controlled so as to correct for the skew of the sheet based on the detected amount of skew and the determined amount of toner used.

11 Claims, 20 Drawing Sheets

FIG.14

| AMOUNT OF TONER USED DIFFERENCE CORRECTION VALUE $\alpha$ | | | | | |
|---|---|---|---|---|---|
| | | AMOUNT OF TONER USED DL IN REGION 11L | | | |
| | | 1 | 2 | 3 | 4 |
| AMOUNT OF TONER USED DR IN REGION 11R | 1 | 0 | 1 | 2 | 3 |
| | 2 | -1 | 0 | 1 | 2 |
| | 3 | -2 | -1 | 0 | 1 |
| | 4 | -3 | -2 | -1 | 0 |

FIG.17

| FRICTION COEFFICIENT CORRECTION VALUE $\beta$R ( $\beta$L) | | | | | |
|---|---|---|---|---|---|
| | | SHEET SURFACE FRICTION COEFFICIENT $\mu$ | | | |
| | | 1 | 2 | 3 | 4 |
| AMOUNT OF TONER USED DR (DL) | 1 | 0 | 1 | 2 | 3 |
| | 2 | -1 | 0 | 1 | 2 |
| | 3 | -2 | -1 | 0 | 1 |
| | 4 | -3 | -2 | -1 | 0 |

FIG.18

| CORRECTION VALUE $\gamma$ FOR FRICTION COEFFICIENT CORRECTION VALUE DIFFERENCE | | | | | | | | |
|---|---|---|---|---|---|---|---|---|
| | | FRICTION COEFFICIENT CORRECTION VALUE $\beta$L FOR SECOND SKEW CORRECTION ROLLER PAIR 2L | | | | | | |
| | | -3 | -2 | -1 | 0 | 1 | 2 | 3 |
| FRICTION COEFFICIENT CORRECTION VALUE $\beta$R FOR FIRST SKEW CORRECTION ROLLER PAIR 2R | -3 | 0 | 1 | 2 | 3 | 4 | 5 | 6 |
| | -2 | -1 | 0 | 1 | 2 | 3 | 4 | 5 |
| | -1 | -2 | -1 | 0 | 1 | 2 | 3 | 4 |
| | 0 | -3 | -2 | -1 | 0 | 1 | 2 | 3 |
| | 1 | -4 | -3 | -2 | -1 | 0 | 1 | 2 |
| | 2 | -5 | -4 | -3 | -2 | -1 | 0 | 1 |
| | 3 | -6 | -5 | -4 | -3 | -2 | -1 | 0 |

IMAGE FORMING APPARATUS AND SHEET CONVEYING METHOD THAT CORRECT FOR SKEW OF SHEET CONVEYED TO IMAGE FORMING UNIT

BACKGROUND OF THE INVENTION

1. Field of the Invention

The present invention relates to an image forming apparatus and a sheet conveying method, and in particular to an image forming apparatus and a sheet conveying method that correct for skew of a sheet being conveyed to an image forming unit.

2. Description of the Related Art

Image forming apparatuses such as copiers, printers, and facsimiles have a conveying unit that conveys a sheet such as a recording sheet or an OHP sheet to an image forming unit. According to those image forming apparatuses, a sheet is conveyed to the image forming unit by the conveying unit, and an image formed by the image forming unit is transferred to the sheet, so that an image is formed on the sheet.

Some of such image forming apparatuses having a conveying unit have a skew correction unit to correct for sheet skew so as to prevent a skewed sheet from being conveyed to the image forming unit, and correction systems using the skew correction unit include a loop forming system and an active registration system.

In the loop forming system, skew is corrected for by pressing a sheet onto a roller pair being at a standstill to form a loop in the sheet.

On the other hand, in the active registration system, skew is corrected for by turning a sheet while conveying it using two sensors and two roller pairs which are individually rotating (see Japanese Laid-Open Patent Publication (Kokai) No. H10-032682). Specifically, first, a skew amount of a sheet is computed based on a difference between generation timings of detection signals which are generated when a leading end of the sheet passes the two sensors provided on a common axis perpendicular to a sheet conveying direction of a sheet conveying path. Then, according to the computed skew amount, the rotational speeds of the respective two roller pairs provided at different locations in a direction perpendicular to the sheet conveying direction are individually controlled. For example, the rotational speed of one roller pair is controlled to be higher or lower than that of the other roller pair, so that skew of the sheet is corrected for.

Incidentally, to improve the performance of the image forming apparatuses, an image forming operation must be speeded up, but the above described loop forming system is not suitable because a sheet being conveyed must be temporarily stopped so as to form a loop in the sheet, and hence correction requires long time.

On the other hand, in the active registration system, skew of a sheet is corrected for without temporarily stopping conveyance of the sheet, and hence the time required for correction is shorter than in the loop forming system. Moreover, the sheet interval between a preceding sheet and a following sheet can be shortened as compared to the loop forming system, resulting in enhancement of sheet conveying efficiency.

However, as the sheet conveying speed increases, rollers contacting on a sheet become more prone to slip. The amount of slip is related to sheet surface characteristics. For example, when in double-sided recording, a sheet with an image transferred to a first side thereof is conveyed for image formation on a second side of the sheet, the amount of slip increases as the amount of toner used for image formation on the first side of the sheet increases. In this case, an image formed on the sheet is misaligned to a large degree, and hence even in the above described active registration system, it is difficult to correct for the misalignment.

SUMMARY OF THE INVENTION

The present invention provides an image forming apparatus and a sheet conveying method that can reliably correct for skew of a sheet being conveyed.

Accordingly, a first aspect of the present invention provides an image forming apparatus comprising a conveying unit configured to convey a sheet, a plurality of conveying roller pairs provided in a direction intersecting a direction in which the sheet is conveyed, and configured to be driven independently of each other, a skew amount detection unit configured to detect a skew amount of the sheet conveyed by the conveying unit, a toner amount determination unit configured to determine a toner amount for an image formed on the sheet, and a control unit configured to correct for skew of the sheet by controlling driving speeds for the plurality of roller pairs independently of each other based on the skew amount detected by the skew amount detection unit and the toner amount determined by the toner amount determination unit.

Accordingly, a second aspect of the present invention provides an image forming apparatus that forms images on both surfaces of a sheet, comprising an image forming unit, a conveying unit configured to convey the sheet to the image forming unit, a correction unit comprising a plurality of roller pairs provided in a direction intersecting a direction in which the sheet is conveyed, and individually adjusting a speed at which the sheet is conveyed, and configured to correct for skew of the sheet conveyed by the conveying unit, a skew amount detection unit configured to detect a skew amount of the sheet conveyed by the conveying unit, a toner amount determination unit configured to determine an amount of toner for an image formed on a first surface of the sheet, and a control unit configured to, in conveying the sheet with the image formed on the first surface thereof to the image forming unit so as to form an image on a second surface of the sheet, control the correction unit based on the skew amount detected by the skew amount detection unit and the toner amount determined by the toner amount determination unit.

Accordingly, a third aspect of the present invention provides a sheet conveying method for an image forming apparatus which has an image forming unit, a conveying unit that conveys a sheet, and a correction unit that has a plurality of roller pairs provided in a direction intersecting a direction in which the sheet is conveyed, and individually adjusting a speed at which the sheet is conveyed, and corrects for skew of the sheet conveyed by the conveying unit, and forms images on both surfaces of the sheet, comprising a skew amount detection step of detecting a skew amount of the conveyed sheet, a toner amount determination step of determining a toner amount for an image formed on a first surface of the sheet, and a control step of, in conveying the sheet with the image formed on the first surface thereof to the image forming unit so as to form an image on a second surface of the sheet, controlling the correction unit based on the skew amount detected in the skew amount detection step and the toner amount determined in the toner amount determination step.

Accordingly, a fourth aspect of the present invention provides a sheet conveying method for an image forming apparatus which has a conveying unit that conveys a sheet, and a plurality of conveying roller pairs provided in a direction intersecting a direction in which the sheet is conveyed, and are driven independently of each other, comprising a skew amount detection step of detecting a skew amount of the sheet conveyed by the conveying unit, a toner amount determination step of determining a toner amount for an image formed on the sheet, and a control step of correcting for skew of the sheet by controlling driving speeds for the plurality of roller pairs independently of each other based on the skew amount detected in the skew amount detection step and the toner amount determined in the toner amount determination step.

According to the present invention, because skew of a sheet is corrected for based on the skew amount of the sheet and the amount of toner used for an image formed on the sheet, skew of a sheet during conveyance of the sheet having an image formed on a first surface thereof so as to form an image on a second surface of the sheet can be reliably corrected for.

Further features of the present invention will become apparent from the following description of exemplary embodiments (with reference to the attached drawings).

BRIEF DESCRIPTION OF THE DRAWINGS

FIG. 14 is a view showing a table for obtaining a correction value a based on the amount of toner used according to the first embodiment.

FIG. 17 is a view showing a table for obtaining a friction coefficient correction value β using the amount of toner used and a sheet surface friction coefficient according to a second embodiment.

FIG. 18 is a view showing a table for obtaining a correction value β for a difference in friction coefficient between skew correction rollers according to the second embodiment.

DESCRIPTION OF THE EMBODIMENTS

The present invention will now be described in detail with reference to the drawings showing embodiments thereof.

Figure 1:
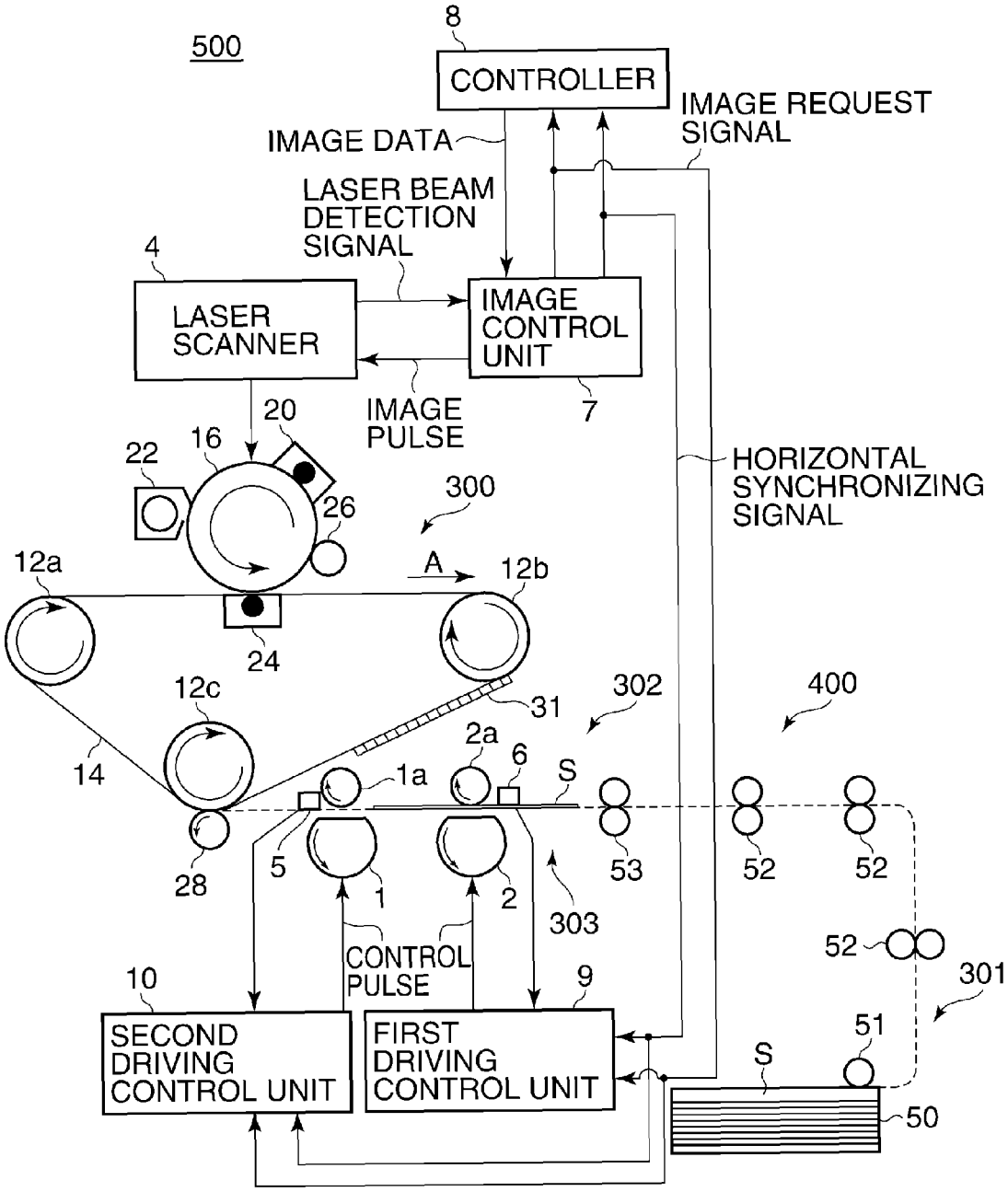
FIG. 1 is a diagram schematically showing an internal arrangement of an image forming apparatus having a sheet conveying device according to a first embodiment of the present invention.

FIG. 1 is a diagram schematically showing an internal arrangement of an image forming apparatus according to a first embodiment of the present invention.

Referring to FIG. 1, the image forming apparatus 500 has an image control unit 7 that controls the overall operation of the apparatus, a controller 8, an image forming unit 300 that forms an image on a sheet S, and a conveying unit 400 that conveys the sheet S.

The image control unit 7 generates a horizontal synchronizing signal based on a laser beam detection signal sent from a laser scanner 4, described later, and in synchronization with the horizontal synchronizing signal, sends an image pulse to the laser scanner 4. Also, the image control unit 7 sends an image request signal and a horizontal synchronizing signal to the controller 8, and converts image data sent from the controller 8 into an image pulse having a pulse width corresponding to a data level of the image data. The image request signal is generated by, for example, the image control unit 7 receiving a trigger signal from a CPU, not shown, that performs a sequence of the whole apparatus. It should be noted that the CPU controls the overall operation of the image forming apparatus 500.

Further, in the case of forming an image on one surface (second surface) of the sheet S having an image formed on the other surface (first surface) thereof, the image control unit 7 determines and stores the amounts of toner used in respective regions where the surface on which the image has been formed and a pair of skew correction rollers 2R and 2L, described later, contact on each other (hereafter referred to as "the amounts of toner used"). The amounts of toner used are sent to a first variable speed determination unit 103R and a second variable speed determination unit 103L, respectively, of a first driving control unit 9, described later. In this case, the image control unit 7 acts as a toner amount determination unit.

The controller 8 temporarily stores image data sent from a PC or a reader, not shown, in an image memory, not shown, and sends the image data to the image control unit 7 in synchronization with an image request signal and a horizontal synchronizing signal from the image control unit 7. After a predetermined number of pulses in the horizontal synchronizing signal have been counted based on the image request signal, the controller 8 synchronizes the image data with the horizontal synchronizing signal and sends the image data to the image control unit 7 every predetermined number of lines.

The image forming unit 300 has the laser scanner 4 and a photoconductive drum 16, which is an image supporting member. A charging unit 20, a developing unit 22, a primary transfer charging unit 24, and a cleaner 26 are disposed around the photosensitive drum 16 and in the rotational direction thereof.

The laser scanner 4 is comprised of a laser beam emitting unit, a polygon mirror, a laser beam detecting sensor, and so on, which are not shown. Based on an image pulse from the image control unit 7, the laser scanner 4 irradiates laser beam onto the photosensitive drum 16 charged by the charging unit 20, thus forming an electrostatic latent image on the photosensitive drum 16. At this time, the polygon mirror deflects and reflects the laser beam emitted from the laser beam emitting unit, and the laser beam detecting sensor sends a laser beam detection signal to the image control unit 7 when detecting the laser beam.

The photosensitive drum 16 is rotated by a motor, not shown, in a direction indicated by an arrow in the figure, and is uniformly charged to a predetermined potential by the charging unit 20 to which a charged bias is applied. The developing unit 22 accommodates toner and forms a toner image by attaching toner to an electrostatic latent image on the photosensitive drum 16. The primary transfer charging unit 24 is disposed at a location opposed to the photosensitive drum 16 such that it can contact on the photosensitive drum 16 via an endless transfer belt 14 tightly stretched between three rollers 12*a* to 12*c*, and constitutes a primary transfer unit for transferring a toner image on the photosensitive drum 16 to the transfer belt 14.

The cleaner 26 cleans the surface of the photosensitive drum 16 by scraping off toner remaining on the photosensitive drum 16 without being transferred to the transfer belt 14. A secondary transfer roller 28 is disposed at a location opposed to the roller 12*c* located at a lower position as viewed in the figure such that it can contact on the roller 12*c* via the transfer belt 14, and constitutes a secondary transfer unit for transferring a toner image 31 from the transfer belt 14 to the sheet S. The conveying unit 400 has a sheet feeding unit 301 and a sheet conveying unit 302. The sheet feeding unit 301 has a cassette 50 that is attachable and detachable to and from an apparatus main body, not shown, and accommodates a plurality of sheets S, and a sheet feeding roller 51 that conveys the sheets S one by one to the sheet conveying unit 302.

The sheet conveying unit 302 has a conveying roller pair 52, a conveying roller pair 53, and a skew correction unit 303. The conveying roller pair 52 conveys the sheet S fed from the sheet feeding unit 301 to the conveying roller pair 53, and the conveying roller pair 53 conveys the sheet S to the secondary transfer unit where the secondary transfer roller 28 and the roller 12*c* contact on each other. The conveying roller pairs 52 and 53 each acts as a conveying unit. It should be noted that the sheet S is conveyed using the middle in the width direction perpendicular to the sheet conveying direction as a conveyance reference.

The skew correction unit 303 has a first sensor unit 6, a second sensor unit 5 as a detecting unit, a skew correction roller unit comprised of cut rollers 2 and driven rollers 2*a*, a timing roller unit comprised of cut rollers 1 and driven rollers 1*a*, the first driving control unit 9 that controls the operation of the skew correction roller unit, and a second driving control unit 10 that controls the operation of the timing roller unit. It should be noted that the skew correction roller unit acts as a correction unit. A detailed description will now be given of the skew correction unit 303 with reference to FIGS. 2 to 4.

Figure 2A:
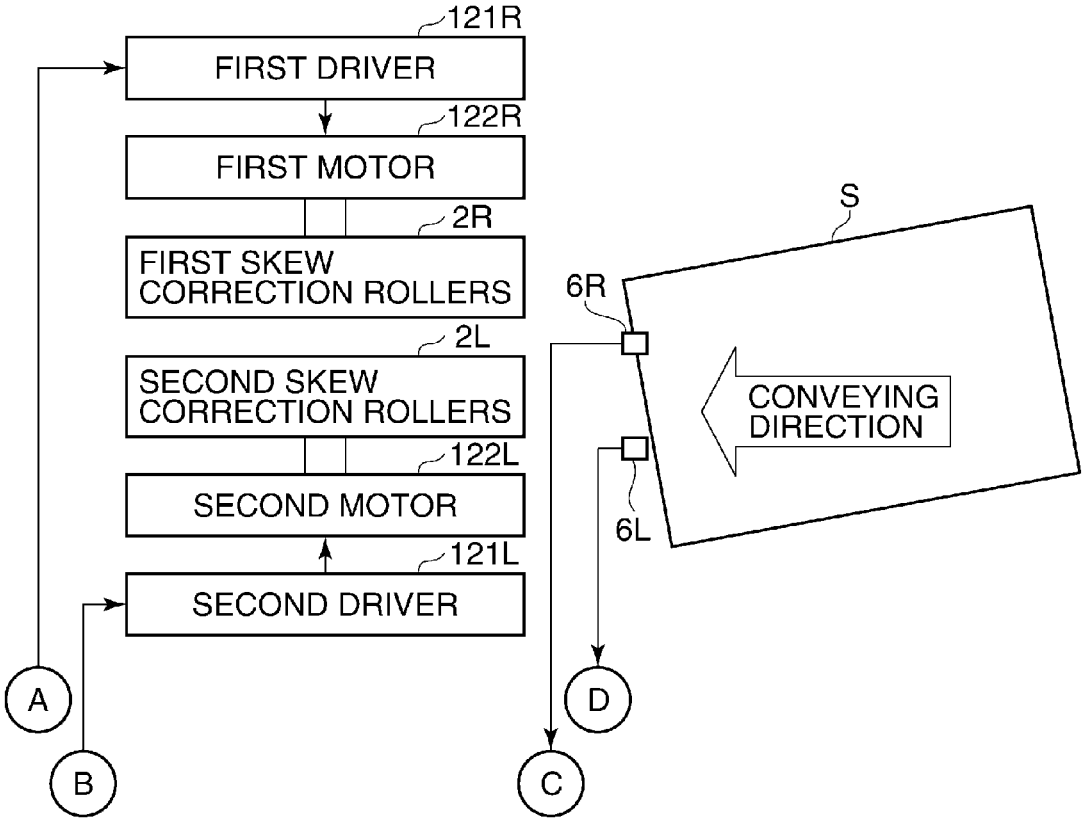
FIGS. 2A and 2B are a block diagrams schematically showing an arrangement of a first driving control unit of a skew correction unit and an arrangement of a skew correction roller unit controlled by the first driving control unit.
Figure 2B:
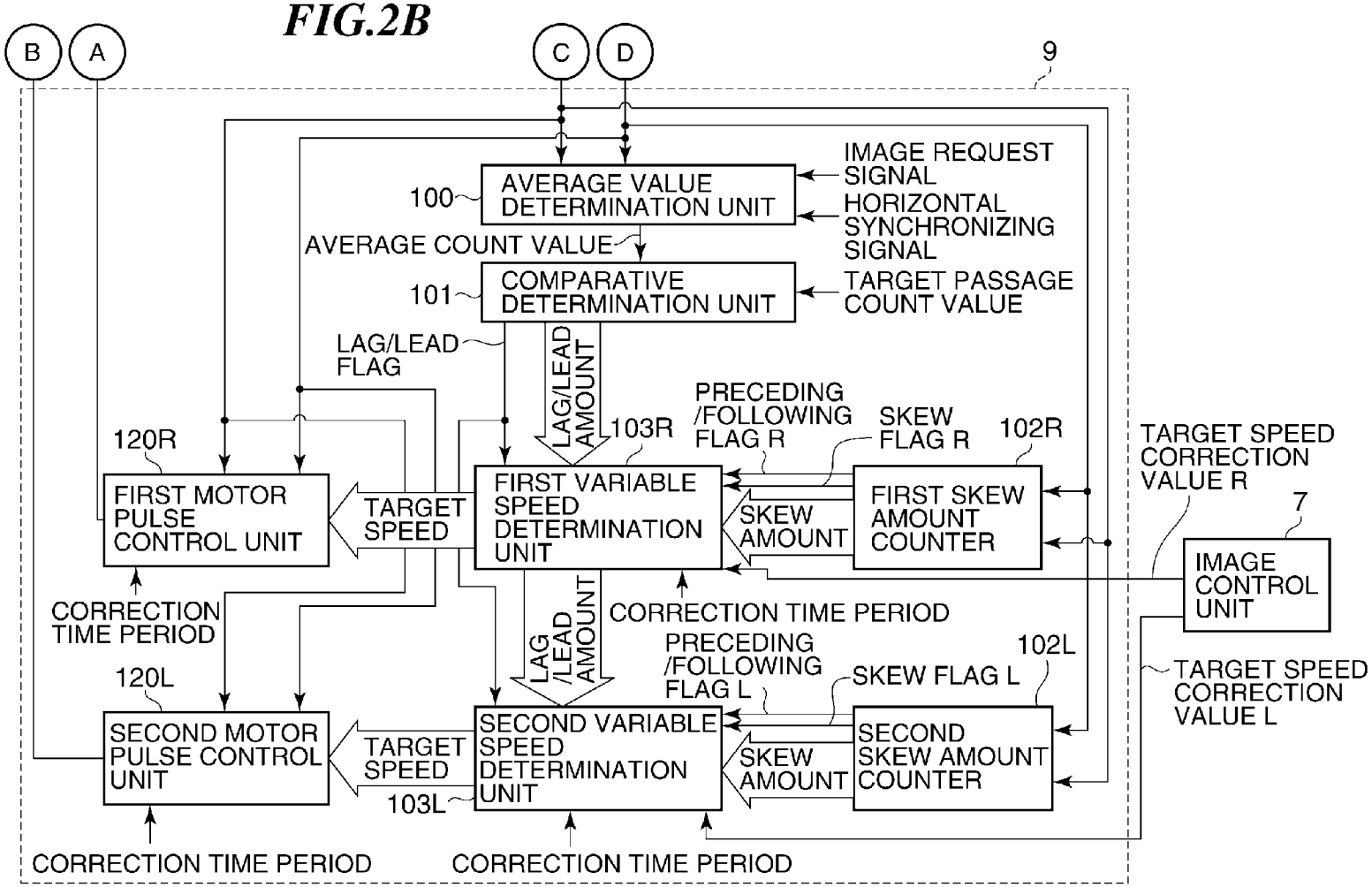

FIGS. 2A and 2B are a block diagrams schematically showing an arrangement of the first driving control unit 9 of the skew correction unit 303 and an arrangement of the skew correction roller unit controlled by the first driving control unit 9.

Referring to FIGS. 2A and 2B, the first driving control unit 9 has a first motor pulse control unit 120R, a second motor pulse control unit 120L, an average value determination unit 100, a comparative determination unit 101, a first skew amount counter 102R, a second skew amount counter 102L, the first variable speed determination unit 103R, and the second variable speed determination unit 103L.

The skew correction roller unit controlled by the first driving control unit 9 is comprised of, for example, a first skew correction roller pair 2R and a second skew correction roller pair 2L which are disposed on the right and left with respect to the direction in which the sheet S is conveyed. The skew correction roller pairs 2R and 2L are each comprised of the cut roller 2 and the driven roller 2*a*, which is disposed such as to face the cut roller 2 across the sheet S being conveyed and follows the cut roller 2. It should be noted that there may be a plurality of skew correction roller units. The skew correction roller pairs 2R and 2L are electrically connected to a first motor 122R and a second motor 122L, respectively, which are drive units, and the motors 122R and 122L are driven by a first driver 121R and a second driver 121L, respectively. The skew correction roller pairs 2R and 2L separately rotate with driving operations of the drivers 121R and 121L, whereby conveying speeds on both sides of the sheet S, which contact on the respective skew correction roller pairs 2R and 2L, in the conveying direction are separately adjusted.

The first sensor unit 6 is comprised of a sensor 6L and a sensor 6R. The sensors 6R and 6L detect a leading end of the sheet S being conveyed, and send sheet detection signals to the first driving control unit 9.

Figure 3:
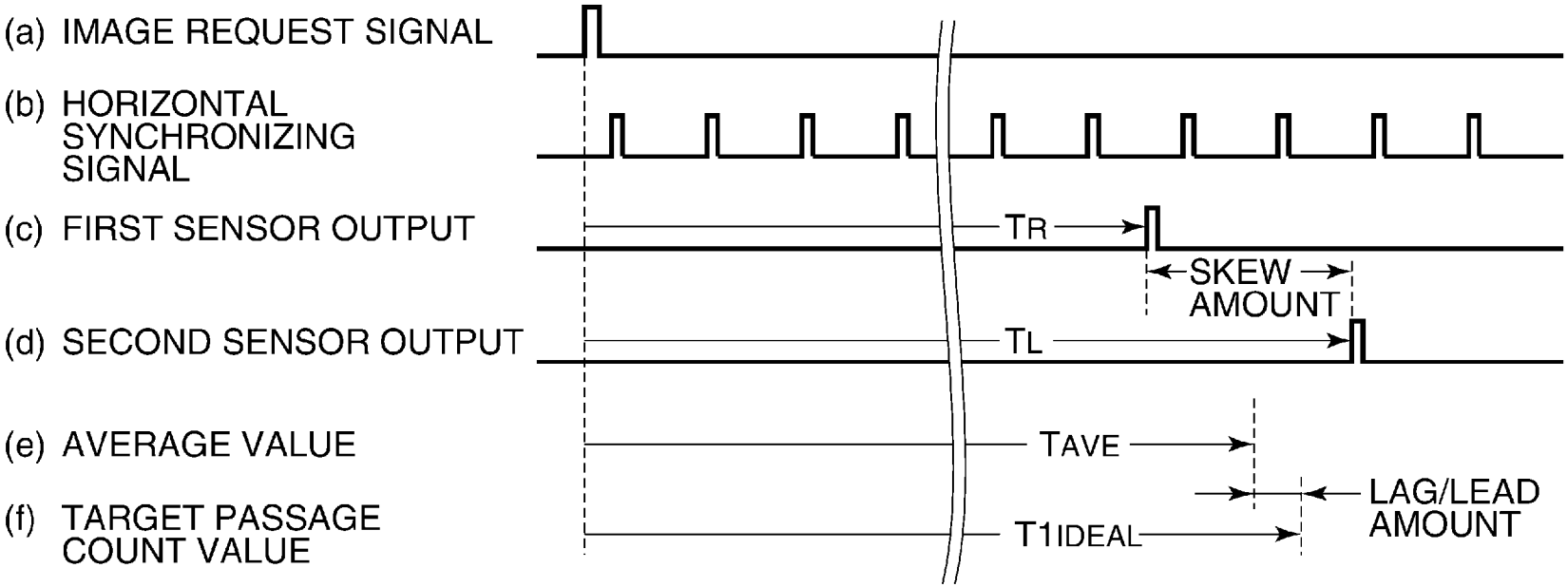
FIG. 3 is a timing chart showing timings of various signals output from an image control unit and signals output from a second sensor unit.

FIG. 3 is a timing chart showing timing of various signals output from the image control unit 7 and signals output from the first sensor unit 6.

The average value determination unit 100, which is a passage timing detection unit, counts the number of pulses in a horizontal synchronizing signal from the image control unit 7, which are shown in FIG. 3(*b*), using an image request signal from the image control unit 7, which is shown in FIG. 3(*a*), as a reference. Also, the average value determination unit 100 latches count values $T_R$ and $T_L$ of the horizontal synchronizing signal shown in FIGS. 3(*c*) and 3(*d*) when the sensor 6R and the sensor 6L detect the leading end of the sheet S, and determines an average value ($T_{AVE}$) thereof shown in FIG. 3(*e*). It should be noted that a clock other than the horizontal synchronizing signal may be counted to determine the average value ($T_{AVE}$).

The average value ($T_{AVE}$) is timing of the sheet S passing a middle point of a line connecting the sensor 6R and the sensor 6L, and this middle point is set as a reference point for determining whether sheet being conveyed is lagging or leading. It should be noted that the reference point should not necessarily be set in this way, but for example, a sensor capable of detecting the middle in the width direction of the sheet S may be disposed, and a signal from this sensor may be set as a reference point.

The comparative determination unit 101 compares the average value ($T_{AVE}$) determined by the average value determination unit 100 and a target passage count value ($T1_{IDEAL}$) shown in FIG. 3(*f*) with each other. Here, the target passage count value ($T1_{IDEAL}$) is timing in which the sheet S should pass the reference point so that a leading end of the toner image 31 on the transfer belt 14 and the leading end of the sheet S can coincide with each other in the secondary transfer unit. Based on the comparison result, the comparative determination unit 101 determines the lag/lead amount of the timing in which the sheet S passes the reference point S relative to the target passage count value, and outputs a lag/lead flag (lag: 0 or lead: 1) and the lag/lead amount to the variable speed determination units 103R and 103L.

The first skew amount counter 102R acting as a skew amount determination unit determines whether or not the output of the sheet detection signal from the sensor 6R precedes the output of the sheet detection signal from the sensor 6L, and determines a skew amount (see FIG. 3) based on the determination result. Also, after the determination, the first skew amount counter 102R outputs a preceding/following flag (preceding: 1 or following: 0), the skew amount, and a skew flag R (skewed: 1 or not-skewed: 0) as determination signals to the variable speed determination unit 103R. It should be noted that the skew amount corresponds to a difference between the count values at time points when the sensors 6R and 6L detect the leading end of the sheet S, "skewed" means a case where a difference between times at which the sensors 6R and 6L detect the leading end of the sheet S is not less than a predetermined time period, and "not skewed" means a case where a difference between times at which the sensors 6R and 6L detect the leading end of the sheet S is less than the predetermined time period.

The second skew amount counter 102L acting as a skew amount determination unit determines whether or not the output of the sheet detection signal from the sensor 6L precedes the output of the sheet detection signal from the sensor 6R, and determines a skew amount based on the determination result. Also, after the determination, the second skew amount counter 102L outputs a preceding/following flag L (precede: 1 or following: 0), the skew amount, and a skew flag L (skewed: 1 or not-skewed: 0) as determination signals to the second variable speed determination unit 103L.

Based on the lag/lead amount and the lag/lead flag from the comparative determination unit 101 and the preceding/following flag, the skew amount, and the skew flag from the first skew amount counter 102R, the first variable speed determination unit 103R determines a target speed Vs1 of sheet conveyance by the first skew correction roller pair 2R. Also, when receiving data on the amount of toner used from the image control unit 7, described later, the first variable speed determination unit 103R determines a target speed Vs3 based on the various signals from the comparative determination unit 101, the various signals from the first skew amount counter 102R, and the amount of toner used from the image control unit 7. The target speed is sent to the first motor pulse control unit 120R.

Similarly to the first variable speed determination unit 103R, the second variable speed determination unit 103L determines a target speed Vs2 of sheet conveyance by the second skew correction roller pair 2L based on the various signals sent from the comparative determination unit 101 and the various signals sent from the second skew amount counter 102L. Also, when receiving data on the amount of toner used from the image control unit 7, described later, the second variable speed determination unit 103L determines a target speed Vs4 based on the various signals from the comparative determination unit 101, the various signals from the second skew amount counter 102L, and the amount of toner used from the image control unit 7. The target speed is sent to the second motor pulse control unit 120L.

Based on the received sheet detection signal and target speed, the first motor pulse control unit 120R acting as a control unit controls the periods of step pulses sent from the first driver 121R to the first motor 122R. This controls the rotational speed of the first skew correction roller pair 2R during sheet conveyance.

Based on the received sheet detection signals and target speeds, the second motor pulse control unit 120L acting as a control unit controls the periods of step pulses sent from the second driver 122L to the second motor 122L. This controls the rotational speed of the second skew correction roller pair 2L during sheet conveyance.

Moreover, on standby for sheet conveyance, the motor pulse control units 120R and 120L receive mark detection signals from home position sensors, not shown, which have detected marks, not shown, provided in the respective skew correction roller pairs 2R and 2L. The motor pulse control units 120R and 120L having received the mark detection signals control the respective motors 122R and 122L via the respective drivers 121R and 121L so that the skew correction roller pairs 2R and 2L stop with the cut portions of the cut rollers 2 turned up. In this case, the cut roller 2 and the driven roller 2*a* of each of the skew correction roller pairs 2R and 2L are spaced apart from each other.

Figure 4:
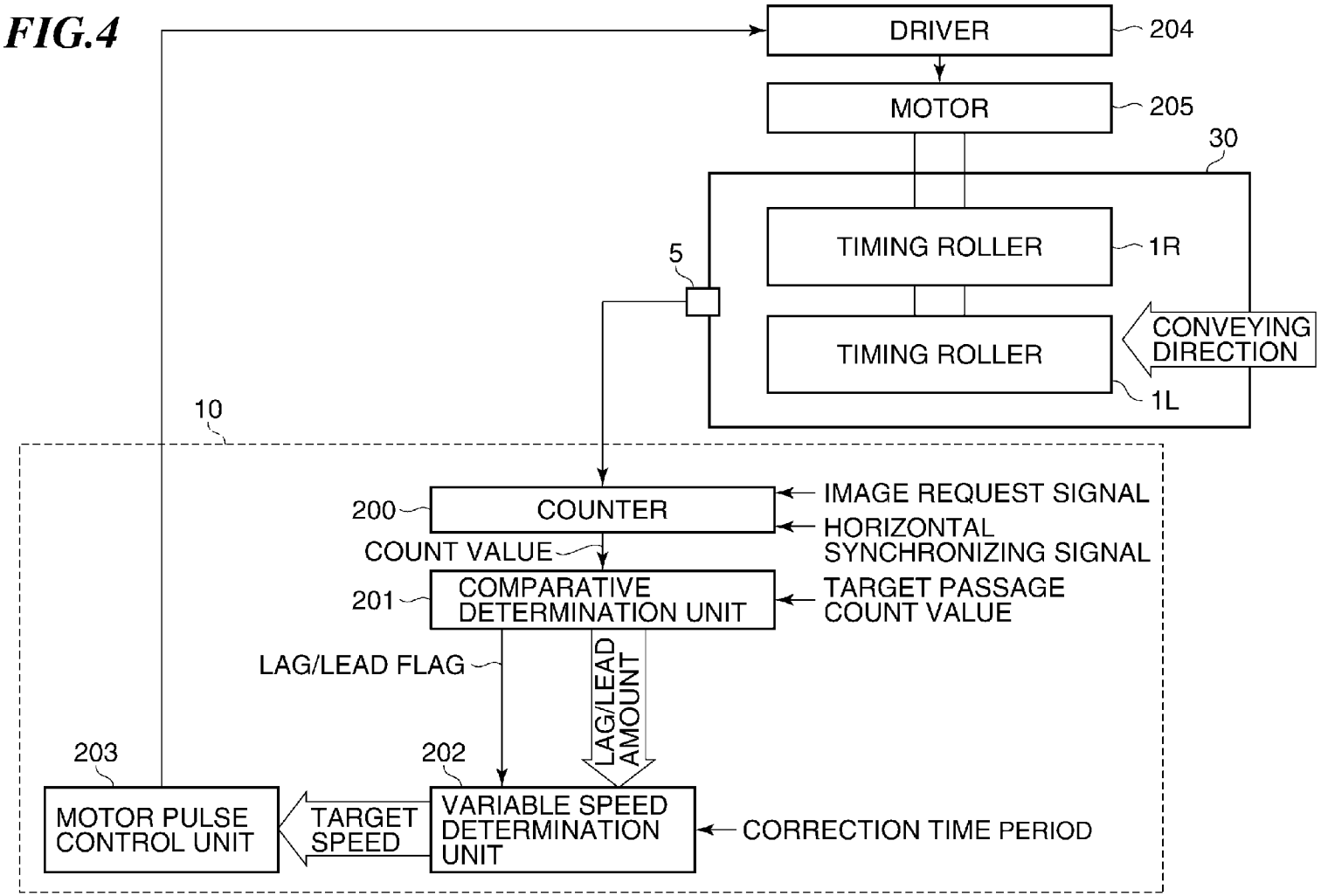
FIG. 4 is a block diagram schematically showing an arrangement of a second driving control unit of the skew correction unit and an arrangement of a timing roller unit controlled by the second driving control unit.

Referring next to FIG. 4, a description will be given of the second driving control unit 10 and the timing roller unit controlled by the second driving control unit 10 in the skew correcting unit 303.

FIG. 4 is a block diagram schematically showing an arrangement of the second driving control unit 10 and the timing roller unit controlled by the second driving control unit 10 in the skew correcting unit 303.

Referring to FIG. 4, the second driving control unit 10 has a counter 200, a comparative determination unit 201, a variable speed determination unit 202, and a motor pulse control unit 203.

The timing roller unit controlled by the second driving control unit 10 is comprised of, for example, a timing roller pair 1R and a timing roller pair 1L which are disposed on the right and left with respect to the direction in which the sheet S is conveyed. The timing roller pairs 1R and 1L are each comprised of the cut roller 1 and the driven roller 1*a*, which is disposed such as to face the cut roller 1 across the sheet S being conveyed and follows the cut roller 1. The timing roller pairs 1R and 1L are rotated by a motor 205, which is driven by a driver 204. The timing roller pairs 1R and 1L rotate with driving operations of the driver 204, whereby the sheet S contacting on the timing roller pairs 1R and 1L is conveyed.

The second sensor unit 5 detects the leading end of the sheet S being conveyed, and sends a sheet detection signal to the second driving control unit 10.

The counter 200 of the second driving control unit 10 having received the sheet detection signal counts the number of pulses in a horizontal synchronizing signal using an image request signal sent from the image control unit 7 (see FIG. 1) as a reference. Also, the counter 200 latches a count value when the second sensor unit 5 detects the leading end of the sheet S, and outputs the latched count value to the comparative determination unit 201.

The comparative determination unit 201 compares the count value of the sheet detection signal and a target passage count value ($T2_{IDEAL}$) with each other. Here, the target passage count value ($T2_{IDEAL}$) is timing in which the leading end of the sheet S should pass the second sensor unit 5 so that the leading end of the toner image 31 on the transfer belt 14 and the leading end of the sheet S can correspond to each other in the secondary transfer unit. Based on the comparison result, the comparative determination unit 201 determines the amount of lag/lead of the timing in which the sheet S passes the second sensor unit 5 relative to the target passage count value, and outputs a lag/lead flag (lag: 0 or lead: 1) and a lag/lead amount to the variable speed determination unit 202.

Based on the lag/lead flag and the lag/lead amount from the comparative determination unit 201, the variable speed determination unit 202 determines a target speed V1 of sheet conveyance by the timing roller pairs 1R and 1L, and sends the target speed V1 to the motor pulse control unit 203.

Based on the received target speed V1 sent from the variable speed determination unit 202, the motor pulse control unit 203 controls the periods of step pulses sent from the driver 204 to the motor 205. This controls the rotational speed of the timing roller pairs 1R and 1L in a direction indicated by an arrow in the figure during sheet conveyance.

Moreover, on standby for sheet conveyance, the motor pulse control unit 203 receives mark detection signals from home position sensors, not shown, which have detected marks, not shown, provided in the respective timing roller pairs 1R and 1L. The motor pulse control unit 203 having received the mark detection signals controls the motors 205 via the driver 204 so that the timing roller pairs 1R and 1L stop with the cut portions of the cut rollers 1 turned up. In this case, the cut roller 1 and the driven roller 1*a* of each of the timing roller pairs 1R and 1L are spaced apart from each other.

Next, a description will be given of an image forming process carried out by the image forming apparatus 500 according to the present embodiment.

First, a description will be given of a case where an image is formed on one surface of the sheet S.

When receiving a trigger signal sent from the CPU, not shown, the image control unit 7 (see FIG. 1) sends an image request signal to the controller 8. The controller 8 having received the image request signal synchronizes image data stored in the image memory, not shown, with the horizontal synchronizing signal, and sends the image data to the image control unit 7. Upon receiving the image data, the image control unit 7 sends an image pulse corresponding to the image data to the laser scanner 4.

The laser scanner 4 having received the image pulse irradiates laser beam corresponding to the image pulse onto the photosensitive drum 16 which has been charged in advance by the charging unit 20 and is rotating. An electrostatic latent image is formed on the photosensitive drum 16 irradiated with the laser beam.

Then, the developing unit 22 attaches toner to the electrostatic latent image, whereby a toner image is formed on the photosensitive drum 16. The toner image formed on the photosensitive drum 16 is transferred onto the transfer belt 14 by the action of a primary transfer bias voltage applied to the primary transfer charging unit 24 in the primary transfer unit. The toner image 31 transferred onto the transfer belt 14 moves in a direction indicated by an arrow A in FIG. 1 with rotation of the rollers 12*a* to 12*c*.

In order that the leading end of the sheet S reaches the secondary transfer unit in timing with the leading end of the toner image 31 reaching the secondary transfer unit, the feeding roller 51 feeds the sheet S held in the cassette 50 toward the closest conveying roller pair 52 in synchronization with the trigger signal sent from the CPU. Sensors, not shown, are disposed in the vicinity of the conveying roller pairs 52, and when detecting the passage of the sheet S, each sensor sends a detection signal to the CPU. The CPU having received the detection signal from each sensor causes a driving control unit, not shown, to drive each conveying roller pair 52. The sheet S is conveyed toward the conveying roller pair 53 with rotation of the driven conveying roller pairs 52, and conveyed toward the skew correction unit 303 by the conveying roller pair 53.

The sensors 6L and 6R detect the leading end of the sheet S being conveyed, and send sheet detection signals to the average value determination unit 100 and the respective skew amount counters 102R and 102L (see FIGS. 2A and 2B). The average value determination unit 100 having received the sheet detection signals latches count values $T_R$ and $T_L$ when the sensors 6L and 6R detect the leading end of the sheet S, determines an average value thereof, and sends the determined average value to the comparative determination unit 101. The comparative determination unit 101 compares the average value from the average value determination unit 100 with the target passage count value $T1_{IDEAL}$ from the image control unit 7, and sends a lag/lead flag and a lag/lead amount as the comparison result to the variable speed determination units 103R and 103L.

On the other hand, the first skew amount counter 102R and the second skew amount counter 102L having received the sheet detection signals determine lag/lead directions and skew amounts of the sheet S based on the times at which the sensors 6R and 6L detect the leading end of the sheet S. The first skew amount counter 102R and the second skew amount counter 102L output preceding/following flags, skew flags, and skew amounts to the variable speed determination units 103R and 103L, respectively. Based on the lag/lead flag and the lag/lead amount from the comparative determination unit 101 and the preceding/following flags, the skew flags, and the skew amounts from the skew amount counter 102R and 102L, the variable speed determination units 103R and 103L determine target speeds Vs1 and Vs2, respectively.

Referring now to FIGS. 5A to 10B, a description will be given of the target speeds Vs1 and Vs2 determined by the variable speed determination units 103R and 103L according to a sheet conveying state.

Each figure A of FIGS. 5A to 10B shows the actual position of the sheet S at the target time $T1_{IDEAL}$ at which the leading end of the sheet S should pass the sensors 6R and 6L at the same time so that the leading end of the toner image 31 and the leading end of the sheet S can coincide with each other in the secondary transfer unit.

Figure 5A:
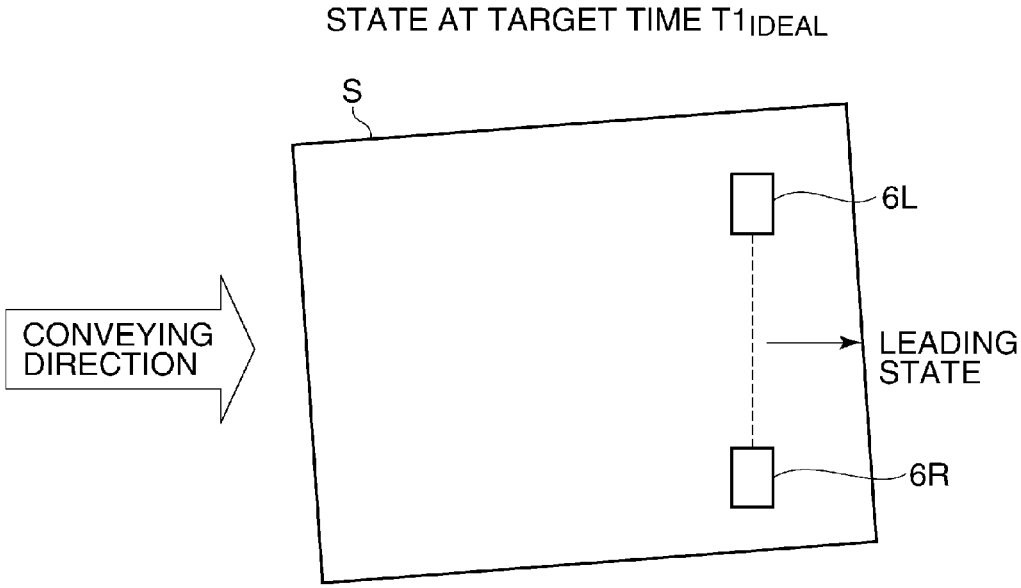
FIGS. 5A and 5B are diagrams useful in explaining a target speed Vs1 according to a sheet conveying state.

Firstly, referring to FIG. 5A, the sheet S is in a leading state relative to the target state, and the sheet S passes the sensor 6R before the sensor 6L. In this case, the lag/lead flag output from the comparative determination unit 101 assumes 1, the preceding/following flag and the skew flag output from the first skew amount counter 102R assume 1 and 1, respectively, and the preceding/following flag and the skew flag output from the second skew amount counter 102L assume 0 and 1, respectively.

Figure 5B:
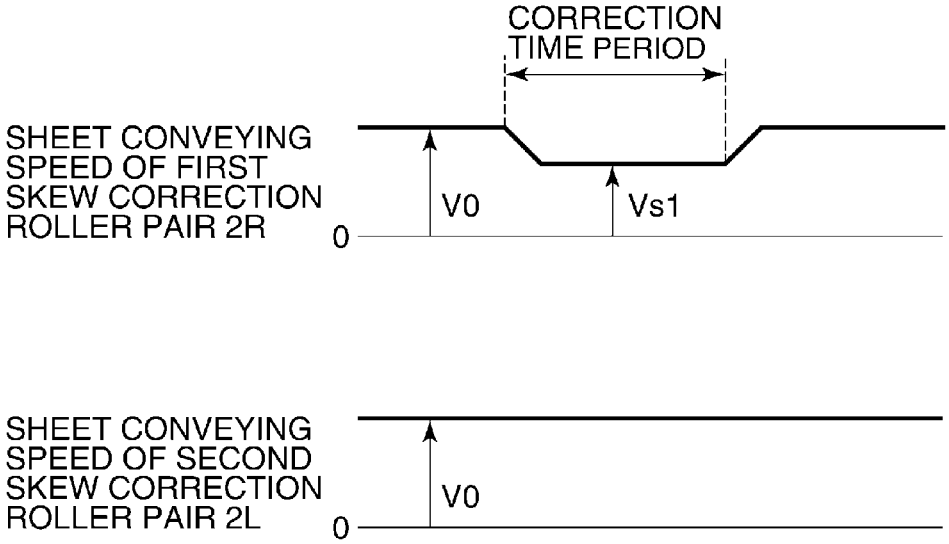

In such a leading state, as shown in FIG. 5B, the first variable speed determination unit 103R determines the target speed Vs1, which is lower than a steady-state speed V0, as a sheet conveying speed for the first skew correction roller pair 2R so as to correct for the leading state. Here, the target speed Vs1 is obtained by subtracting a deceleration amount, which is obtained by dividing the skew amount by a set correction time period (time period obtained by subtracting a transition time period from an actual correction time period), from the steady speed V0 so that the area of a trapezoid of a speed-changing region can be equal to the skew amount when changes in speed are figured. As a result, the conveying speed of the first skew correction roller pair 2R is decreased, and the skew can be corrected for with the sheet S leading from the target state to a smaller degree as compared to a case where the conveying speed of the second skew correction roller pair 2L is increased.

Figure 6A:
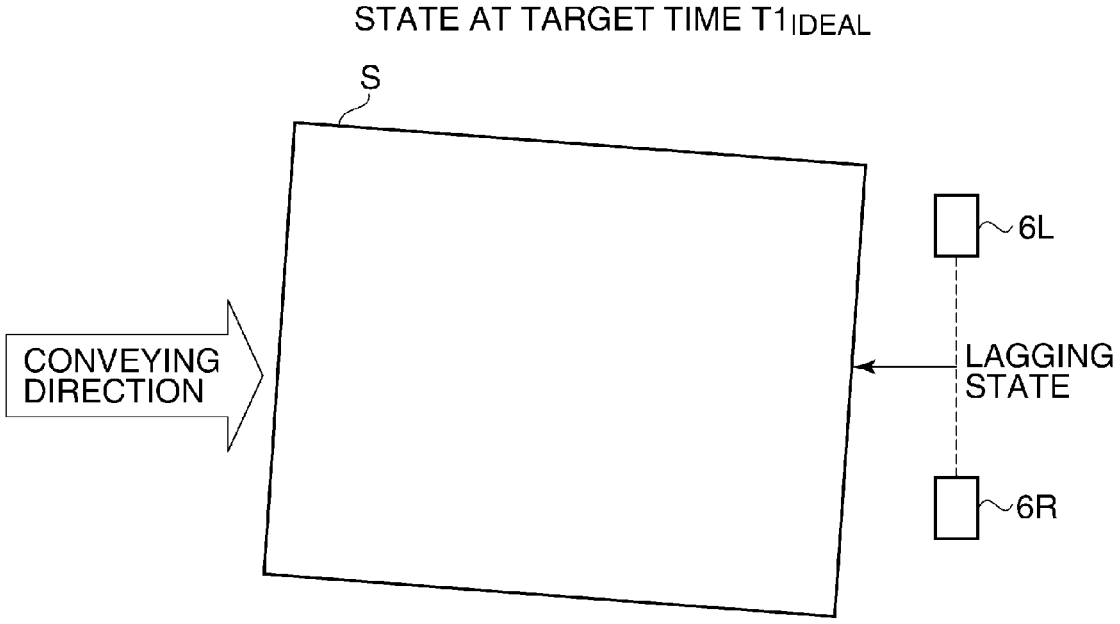
FIGS. 6A and 6B are diagrams useful in explaining the target speed Vs1 according to a sheet conveying state.

Secondly, referring to FIG. 6A, the sheet S is in a lagging state relative to the target state, and the sheet S passes the sensor 6L before the sensor 6R. In this case, the lag/lead flag output from the comparative determination unit 101 assumes 0, the preceding/following flag and the skew flag output from the first skew amount counter 102R assume 0 and 1, respectively, and the preceding/following flag and the skew flag output from the second skew amount counter 102L assume 1 and 1, respectively.

Figure 6B:
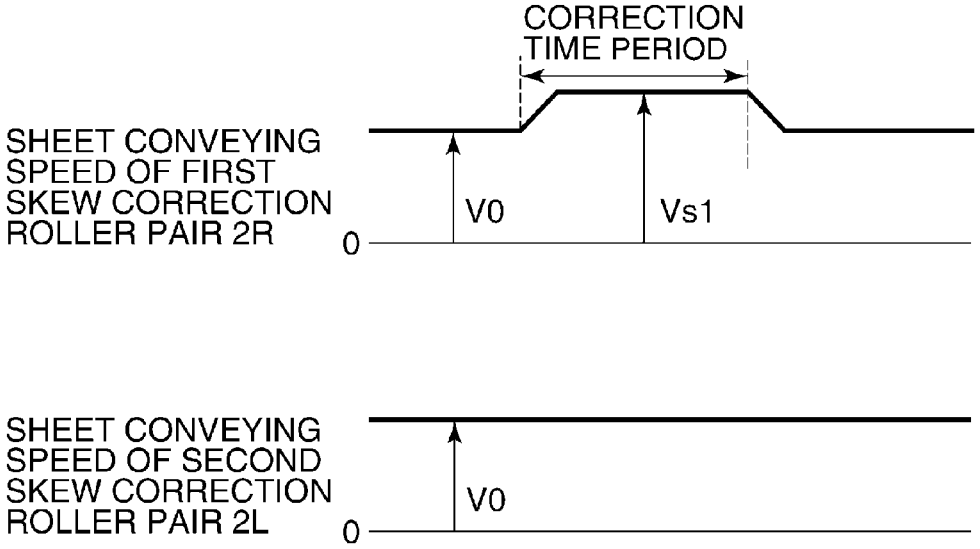

In such a lagging state, as shown in FIG. 6B, the first variable speed determination unit 103R determines the target speed Vs1, which is higher than the steady-state speed V0, as a sheet conveying speed of the first skew correction roller pair 2R so as to correct for the lagging state. As a result, the conveying speed of the first skew correction roller pair 2R is increased, and the skew can be corrected for with the sheet S lagging from the target state to a smaller degree as compared to a case where the conveying speed of the first skew correction roller pair 2L is decreased.

Figure 7A:
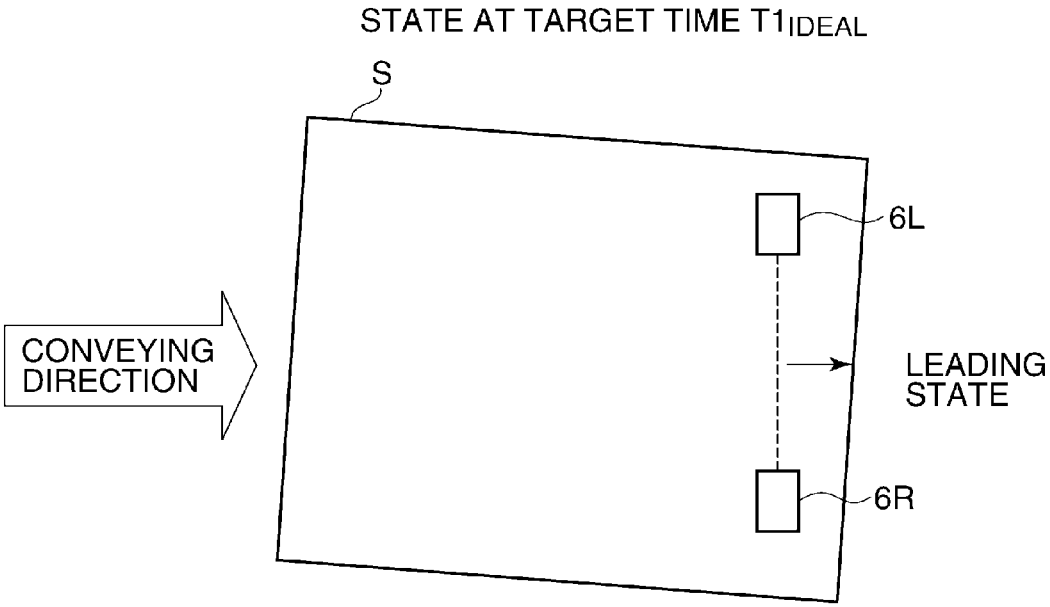
FIGS. 7A and 7B are diagrams useful in explaining a target speed Vs2 according to a sheet conveying state.

Thirdly, referring to FIG. 7A, the sheet S is in a leading state relative to the target state, and the sheet S passes the sensor 6L before the sensor 6R. In this case, the lag/lead flag output from the comparative determination unit 101 assumes 1, the preceding/following flag and the skew flag output from the first skew amount counter 102R assume 0 and 1, respectively, and the preceding/following flag and the skew flag output from the second skew amount counter 102L assume 1 and 1, respectively.

Figure 7B:
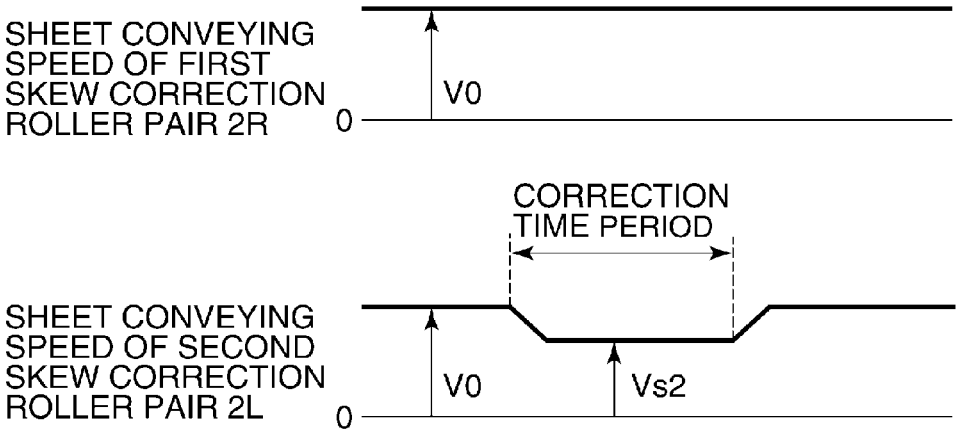

In such a leading state, as shown in FIG. 7B, the second variable speed determination units 103L determines the target speed Vs2, which is lower than the steady-state speed V0, as a sheet conveying speed of the second skew correction roller pair 2L so as to correct for the leading state. It should be noted that the target speed Vs2 is determined in the same way as in the way in which the target speed Vs1 is determined. As a result, the conveying speed of the second skew correction roller pair 2L is decreased, and the skew can be corrected for with the sheet S leading from the target state to a smaller degree as compared to a case where the conveying speed of the first skew correction roller pair 2R is increased.

Figure 8A:
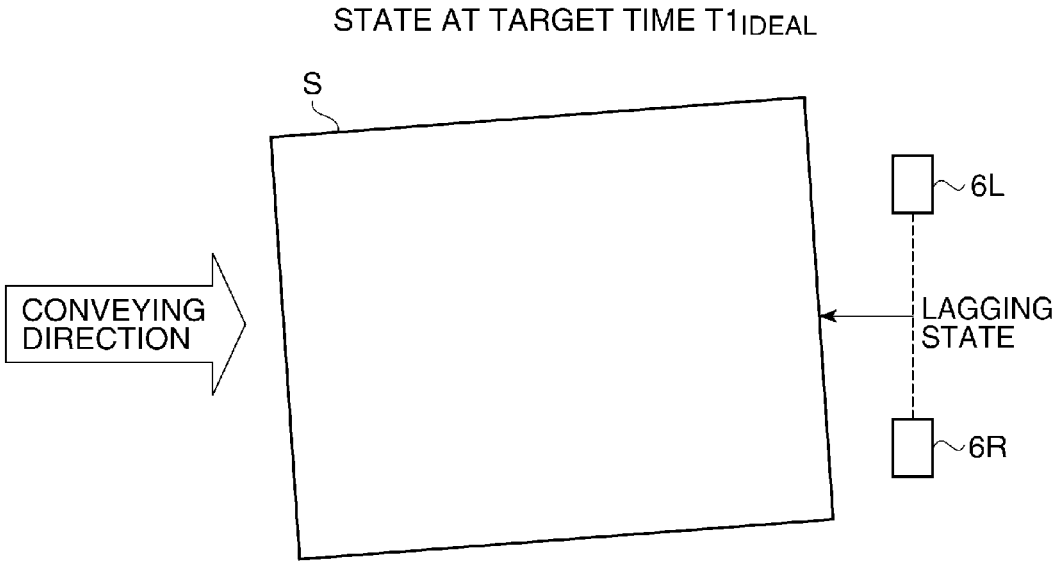
FIGS. 8A and 8B are diagrams useful in explaining the target speed Vs2 according to a sheet conveying state.

Fourthly, referring to FIG. 8A, the sheet S is in a lagging state relative to the target state, and the sheet S passes the sensor 6R before the sensor 6L. In this case, the lag/lead flag output from the comparative determination unit 101 assumes 0, the preceding/following flag and the skew flag output from the first skew amount counter 102R assume 1 and 1, respectively, and the preceding/following flag and the skew flag output from the second skew amount counter 102L assume 0 and 1, respectively.

Figure 8B:
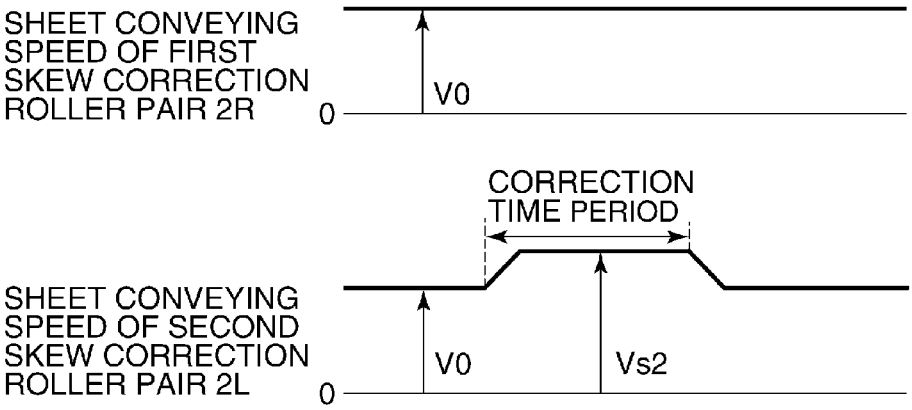

In such a lagging state, as shown in FIG. 8B, the second variable speed determination unit 103L determines the target speed Vs2, which is higher than the steady-state speed V0, as a sheet conveying speed of the second skew correction roller pair 2L so as to correct for the lagging state. As a result, the conveying speed of the second skew correction roller pair 2L is increased, and the skew can be corrected for with the sheet S lagging from the target state to a smaller degree as compared to a case where the conveying speed of the first skew correction roller pair 2R is decreased.

Figure 9A:
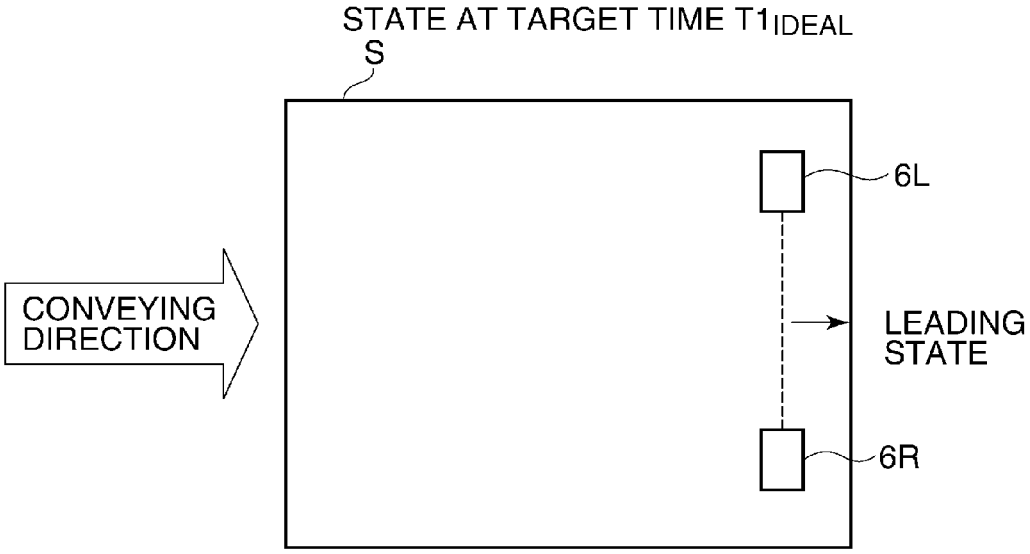
FIGS. 9A and 9B are diagrams useful in explaining the target speeds Vs1 and Vs2 according to a sheet conveying state.

Fifthly, referring to FIG. 9A, the sheet S is in a leading state relative to the target state, and the sheet S passes the sensors 6R and 6L at the same time. In this case, the lag/lead flag output from the comparative determination unit 101 assumes 1, the preceding/following flag and the skew flag output from the first skew amount counter 102R assume 1 and 0, respectively, and the preceding/following flag and the skew flag output from the second skew amount counter 102L assume 1 and 0, respectively.

Figure 9B:
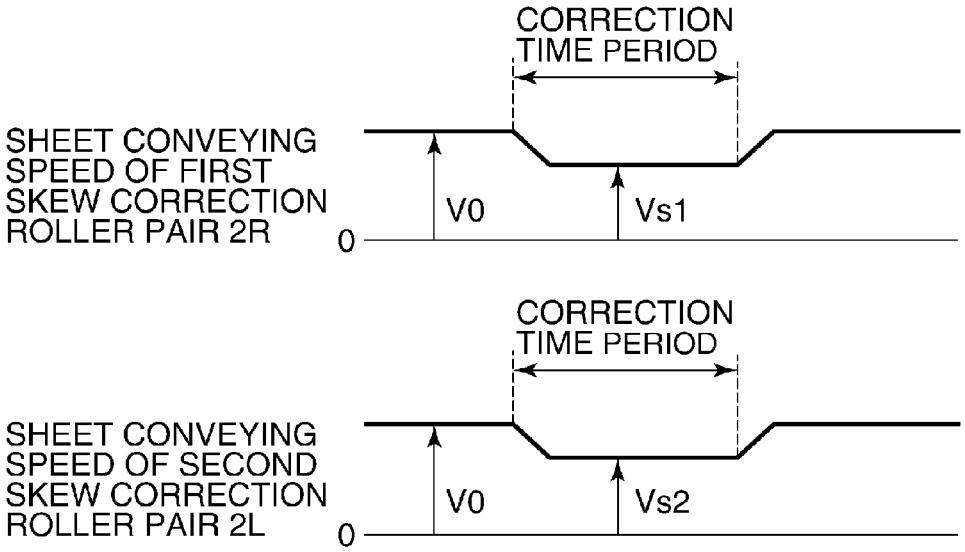

In such a leading state, as shown in FIG. 9B, the variable speed determination units 103R and 103L determine the target speeds Vs1 and Vs2, which are lower than the steady-state speed V0, as sheet conveying speeds of the respective skew correction roller pairs 2R and 2L so as to correct for the leading state. As a result, the skew can be corrected for with the sheet S leading from its target state to a small degree.

Figure 10A:
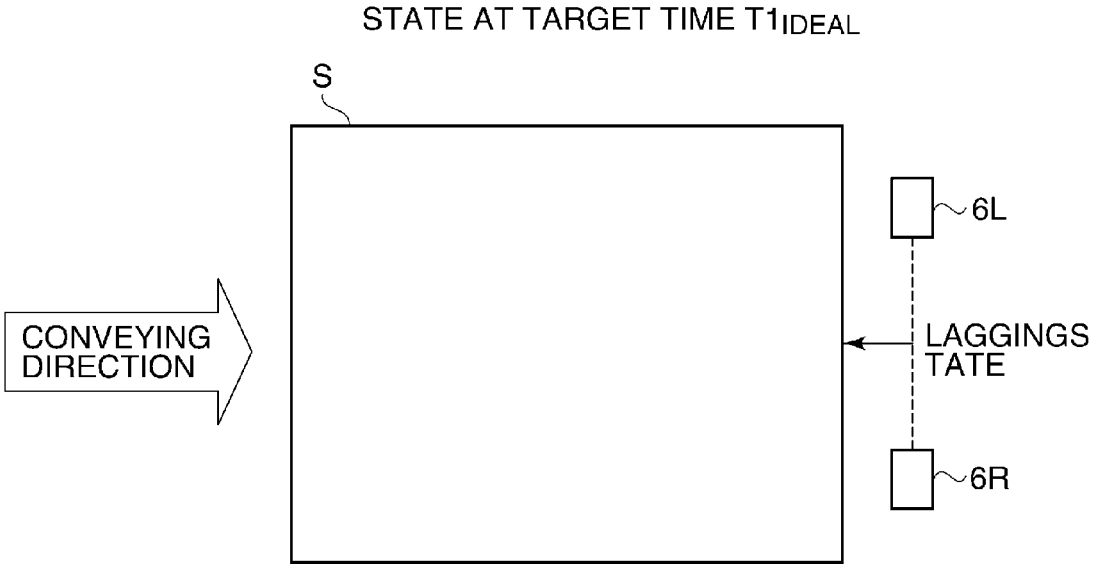
FIGS. 10A and 10B are diagrams useful in explaining the target speeds Vs1 and Vs2 according to a sheet conveying state.

Sixthly, referring to FIG. 10A, the sheet S is in a lagging state relative to the target state, and the sheet S passes the sensors 6R and 6L at the same time. In this case, the lag/lead flag output from the comparative determination unit 101 assumes 0, the preceding/following flag and the skew flag output from the first skew amount counter 102R assume 1 and 0, respectively, and the preceding/following flag and the skew flag output from the second skew amount counter 102L assume 1 and 0, respectively.

Figure 10B:
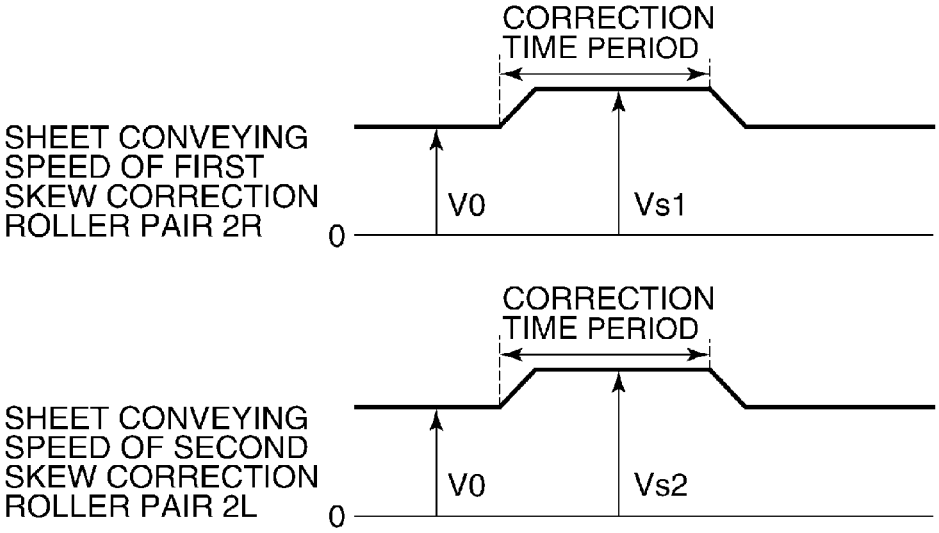

In such a lagging state, as shown in FIG. 10B, the variable speed determination units 103R and 103L determine the target speeds Vs1 and Vs2, which are higher than the steady-state speed V0, as sheet conveying speeds of the respective skew correction roller pairs 2R and 2L so as to correct for the lagging state. As a result, the skew can be corrected for with the sheet S lagging from its target state to a small degree.

The variable speed determination units 103R and 103L having determined the target speeds as described above send the determined target speeds to the motor pulse control units 120R and 120L, respectively. Based on the received target speeds, the motor pulse control units 120R and 120L control the rotational speeds of the respective skew correction rollers 2R and 2L via the respective drivers 121R and 121L. As a result, the skew of the sheet S is corrected for, and the degree of lagging or leading is corrected for or reduced.

The sheet S of which skew has been corrected for and of which degree of lagging or leading has been reduced by the first driving control unit 9 is conveyed toward the timing roller pairs 1R and 1L, and the second sensor unit 5 detects the leading end of the conveyed sheet S and sends a sheet detection signal to the counter 200 (see FIG. 4).

The counter 200 having received the sheet detection signal latches a count value when the second sensor unit 5 detects the leading end of the conveyed sheet S, and sends the count value to the comparative determination unit 201. The comparative determination unit 201 compares the count value from the counter 200 with the ideal passage count value $T2_{IDEAL}$ from the image control unit 7, and sends a lag/lead flag and a lag/lead amount as comparison results to the variable speed determination unit 202. The variable speed determination unit 202 determines the target speed V1 based on the lag/lead flag and the lag/lead amount from the comparative determination unit 201.

Figure 11A:
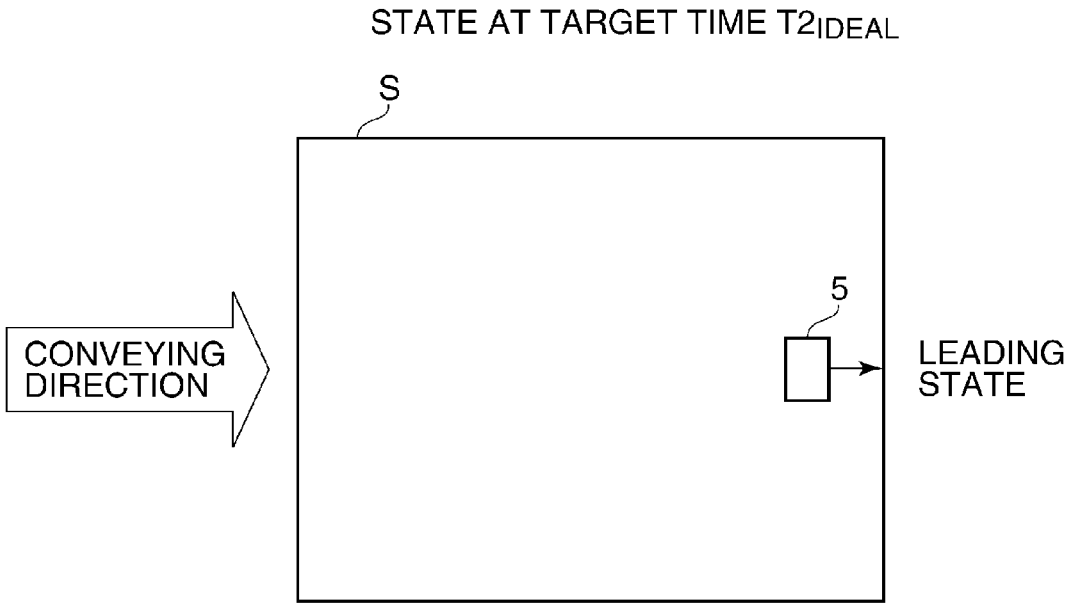
FIGS. 11A and 11B are diagrams useful in explaining a target speed V1 according to a sheet conveying state.
Figure 11B:
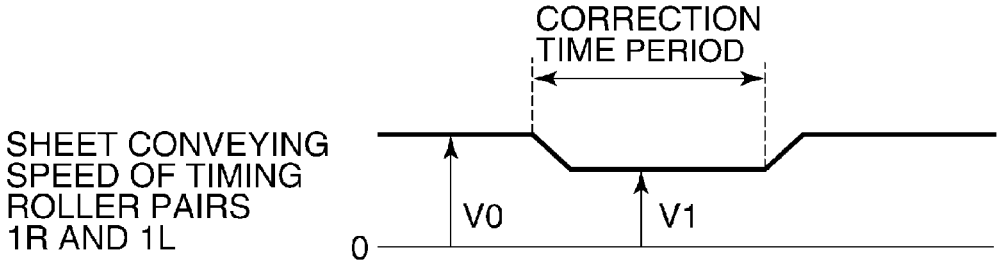

For example, when the sheet S is being conveyed in a state shown in FIG. 11A, the sheet S is in a leading state relative to the target state, and hence the lag/lead flag output from the comparative determination unit 201 assumes 1. In such a leading state, as shown in FIG. 11B, the variable speed determination unit 202 determines the target speed V1 lower than the steady-state speed V0 as sheet conveying speeds of the timing roller pairs 1R and 1L so as to correct for the leading state.

Figure 12A:
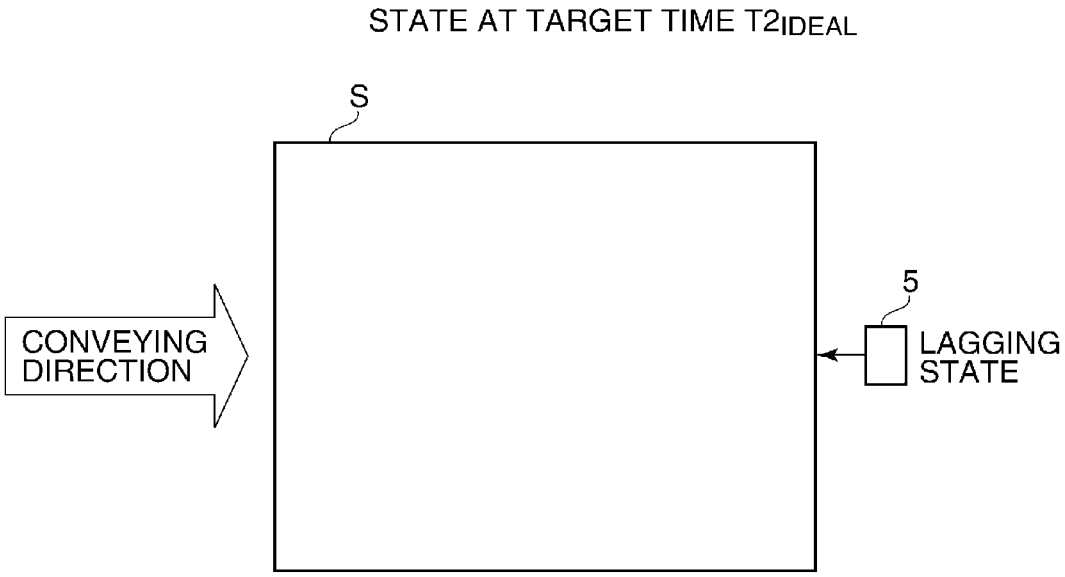
FIGS. 12A and 12B are diagrams useful in explaining the target speed V1 according to a sheet conveying state.
Figure 12B:
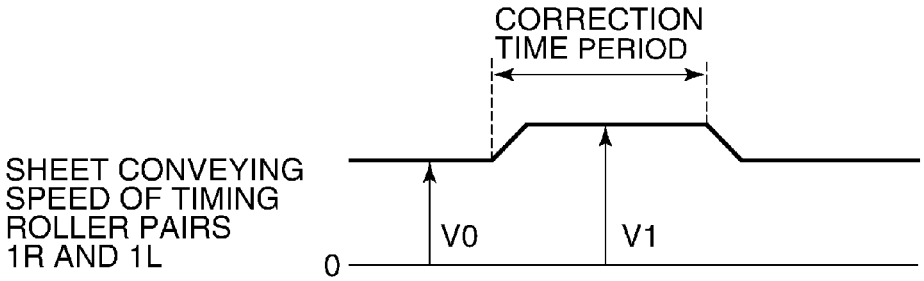

Also, for example, when the sheet S is being conveyed in a state shown in FIG. 12A, the sheet S is in a lagging state relative to the target state, and hence the lag/lead flag output from the comparative determination unit 201 assumes 0. In such a lagging state, as shown in FIG. 12B, the variable speed determination unit 202 determines the target speed V1 higher than the steady-state speed V0 as sheet conveying speeds of the timing roller pairs 1R and 1L so as to correct for the lagging state. It should be noted that the target speed V1 is determined in the same way as the way in which the target speeds Vs1 and Vs2 are determined.

The variable speed determination unit 202 having determined the target speed V1 sends the determined target speed V1 to the motor pulse control unit 203. Based on the received target speed V1, the motor pulse control unit 203 controls the rotational speeds of the timing roller pairs 1R and 1L via the driver 204. Then, the motor pulse control unit 203 corrects for the lagging or leading of the sheet S, then resets the conveying speed for the sheet S to the steady-state speed V0, and conveys the sheet S to the secondary transfer unit.

The secondary transfer roller 28 transfers the toner image 31 to the sheet S conveyed to the secondary transfer unit. The sheet S to which the toner image has been transferred is conveyed to a fixing unit, not shown, and the toner image is fixed on a surface of the sheet S by the fixing unit heating and pressurizing the sheet S.

Next, a description will be given of an operation in which images are formed on both of front and back surfaces of the sheet S.

This operation is basically the same as the image forming operation in the above described operation in which an image is formed on one surface, and hence description of corresponding operations is omitted, only different operations being described below.

Figure 13:
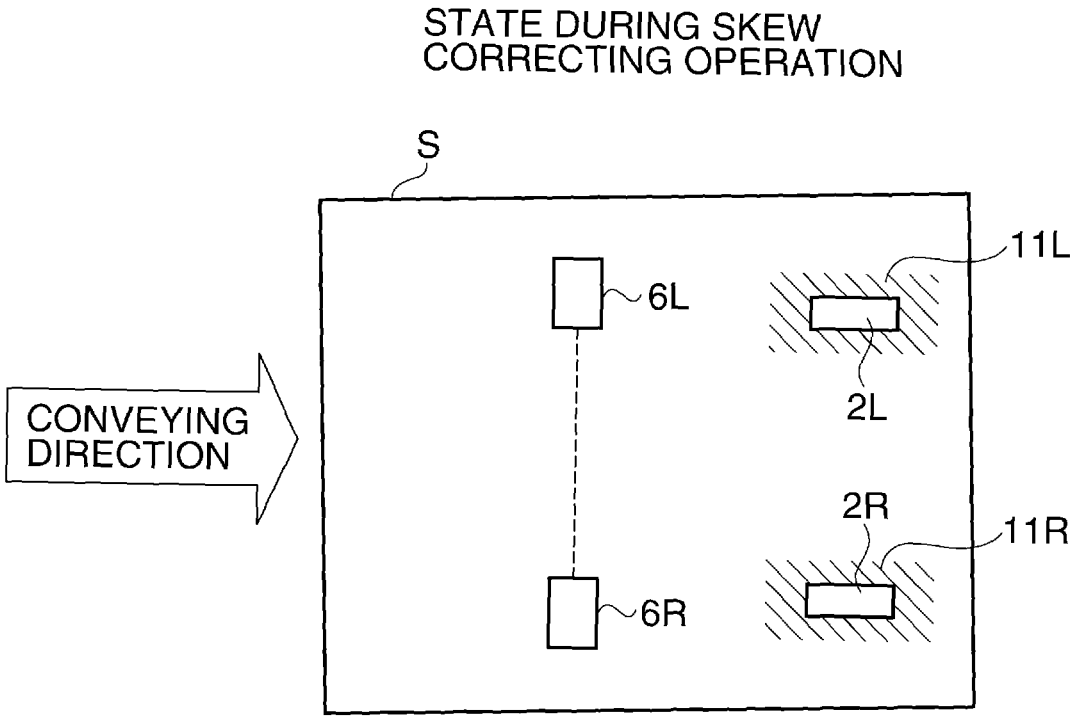
FIG. 13 is a diagram showing regions where a skew correction roller pair and a sheet contact on each other.

By the same operation as described above, a toner image is formed on the photosensitive drum 16, and further, the toner image 31 is transferred onto the transfer belt 14. On this occasion, the image control unit 7 determines amounts of toner used $D_R$ and $D_L$ in respective diagonally shaded regions 11R and 11L shown in FIG. 13 using a known calculation method. The known calculation method is a method using so-called video count values, in which the number of pixels corresponding to a part of an input image signal to which toner is supposed to become attached is counted, and by totalizing the number of pixels in the image signal, a value substantially equivalent to the a amount of toner used on a recording material can be obtained. Here, the regions 11R and 11L are regions where a surface to which the image has been transferred and the skew correction rollers 2R and 2L contact on each other. The image control unit 7 sends the determined amounts of toner used $D_R$ and $D_L$ to the respective variable speed determination units 103R and 103L.

Based on the received amounts of toner used $D_R$ and $D_L$, the respective variable speed determination units 103R and 103L obtain an amount of toner used difference correction value $\alpha$ from a table shown in FIG. 14. It should be noted that the amounts of toner used $D_R$ and $D_L$ are each divided into four stages. Also, the variable speed determination units 103R and 103L determine respective the target speeds Vs1 and Vs2 in the same way as described above. Then, the variable speed determination units 103R and 103L determine target speed Vs3 or Vs4 using the target speed Vs1 or Vs2 and the amount of toner used difference correction value $\alpha$. The target speeds Vs3 and Vs4 are expressed by the following equations (1) and (2) where a predetermined correction adjustment value is Vc:

$$Vs3=Vs1+\alpha Vc \quad (1)$$

$$Vs4=Vs2-\alpha Vc \quad (2)$$

Here, Vc is an adjustment value for correcting for a difference between a computed correction result and an actual correction result, and correcting for subtle apparatus-to-apparatus variations such as mounting positions of sensors and drive rollers.

The variable speed determination units 103R and 103L having determined the target speeds send the determined target speeds to the respective motor pulse control units 120R and 120L. Based on the received target speeds, the motor pulse control units 120R and 120L control the rotational speeds of the respective skew correction roller pairs 2R and 2L.

The sheet S of which skew and lagging or leading have been corrected for with consideration given to the amount of toner used for the toner image transferred to the sheet S as described above is conveyed to the timing roller pairs 1R and 1L, and an image is formed on the other surface of the sheet S in the same way as described above, which completes image formation on both surfaces of the sheet S.

Figure 15:
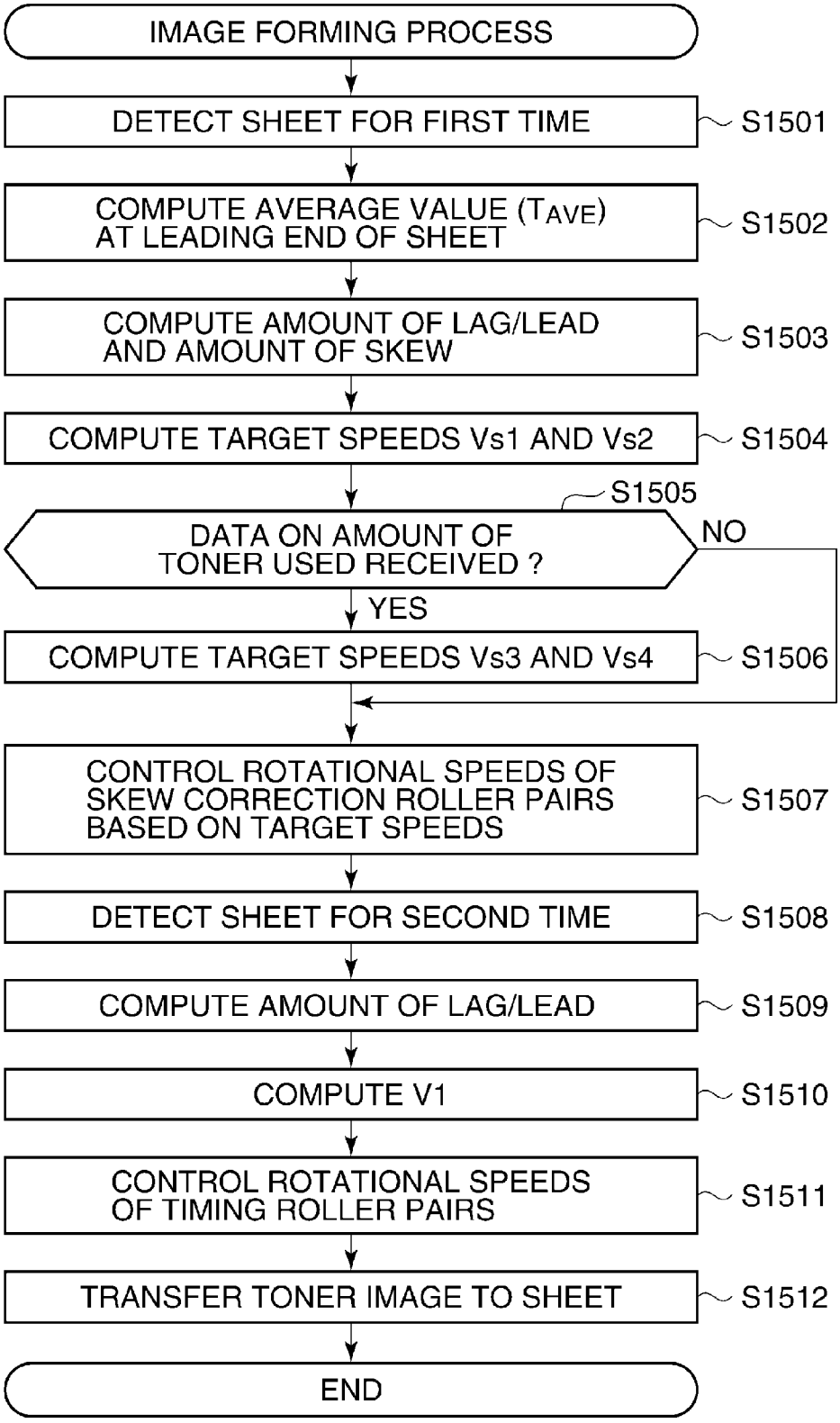
FIG. 15 is a flowchart of an image forming process carried out by the image forming apparatus according to the first embodiment.

Referring next to FIG. 15, a description will be given of an image forming process carried out by the image forming apparatus 500 according to the first embodiment.

FIG. 15 is a flowchart of the image forming process carried out by the image forming apparatus 500 according to the first embodiment.

Referring to FIG. 15, first, the conveying unit 400 drives the feeding roller 51, the conveying roller pairs 52, and the conveying roller pair 53 to convey the sheet S held in the cassette 50 toward the skew correction unit 303. When the sensors 6L and 6R of the skew correction unit 303 detect the leading end of the sheet S (S1501), sheet detection signals are sent to the average value determination unit 100 and the respective skew amount counters 102R and 102L.

The average value determination unit 100 determines the average value ($T_{AVE}$) based on the received sheet detection signals (S1502), and sends the determined average value ($T_{AVE}$) to the comparative determination unit 101. On the other hand, the skew amount counters 102R and 102L detect sheet lagging/leading directions and skew amounts based on the received sheet detection signals (S1503), and send preceding/following flags, skew flags, and skew amounts to the respective variable speed determination units 103R and 103L.

Also, the comparative determination unit 101 determines a lag/lead amount based on the received average value ($T_{AVE}$) and the target passage count value $T1_{IDEAL}$ from the image control unit 7 (S1503), and sends a lag/lead flag and a lag/lead amount to the variable speed determination units 103R and 103L.

Then, the variable speed determination units 103R and 103L determine the target speeds Vs1 and Vs2 based on the lag/lead amount received from the comparative determination unit 101 and the skew amounts received from the skew amount counters 102R and 102L (S1504). After that, the variable speed determination units 103R and 103L determine whether or not they have received data on the amount of toner used from the image control unit 7 (S1505). When the variable speed determination units 103R and 103L have not received data on the amount of toner used, the variable speed determination units 103R and 103L send the determined target speeds Vs1 and Vs2 to the respective motor pulse control units 120R and 120L.

On the other hand, when the variable speed determination units 103R and 103L have received data on the amount of toner used, the variable speed determination units 103R and 103L determine the target speeds Vs3 and Vs4 based on the lag/lead amount, the skew amounts, and the data on the amount of toner used (S1506), and send the determined target speeds Vs3 and Vs4 to the respective motor pulse control units 120R and 120L.

Then, the motor pulse control units 120R and 120L control conveying speeds (rotational speeds) of the respective skew correction roller pairs 2R and 2L based on the received target speeds (S1507). Through the control of the skew correction roller pairs 2R and 2L, the sheet S of which skew and amount of lag/lead relative to the toner image has been adjusted is conveyed toward the timing roller pairs 1R and 1L.

Then, when detecting the leading end of the sheet S conveyed toward the timing roller pairs 1R and 1L (S1508), the second sensor unit 5 sends a sheet detection signal to the counter 200. The counter 200 sends a count value based on the sheet detection signal to the comparative determination unit 201.

The comparative determination unit 201 determines a lag/lead amount based on the count value from the counter 200 and the target passage count value $T2_{IDEAL}$ from the image control unit 7 (S1509), and sends the determined lag/lead amount and a lag/lead flag to the variable speed determination unit 202. The variable speed determination unit 202 determines the target speed V1 based on the received lag/lead amount and lag/lead flag (S1510), and sends the determined target speed V1 to the motor pulse control unit 203.

Then, the motor pulse control unit 203 controls the conveying speeds (rotational speeds) of the timing roller pairs 1R and 1L based on the received target speed V1 (S1511). Through the control of the timing roller pairs 1R and 1L, the sheet S of which lagging or leading amount has been adjusted so that the leading end of the sheet S and the leading end of the toner image on the photosensitive drum 16 can coincide with each other is conveyed toward the secondary transfer unit 28. Then, in the secondary transfer unit 28, the toner image is transferred to the sheet S (S1512).

Next, a description will be given of a second embodiment of the present invention.

An image forming apparatus according to the second embodiment controls the skew correction roller pairs 2R and 2L based on the amount of toner used of an image formed on one surface of the sheet S and sheet surface characteristics.

The overall arrangement of the image forming apparatus according to the present embodiment is the same as that of the image forming apparatus 500 according to the first embodiment, and description of corresponding operations is omitted, only different operations being described below.

Figure 16:
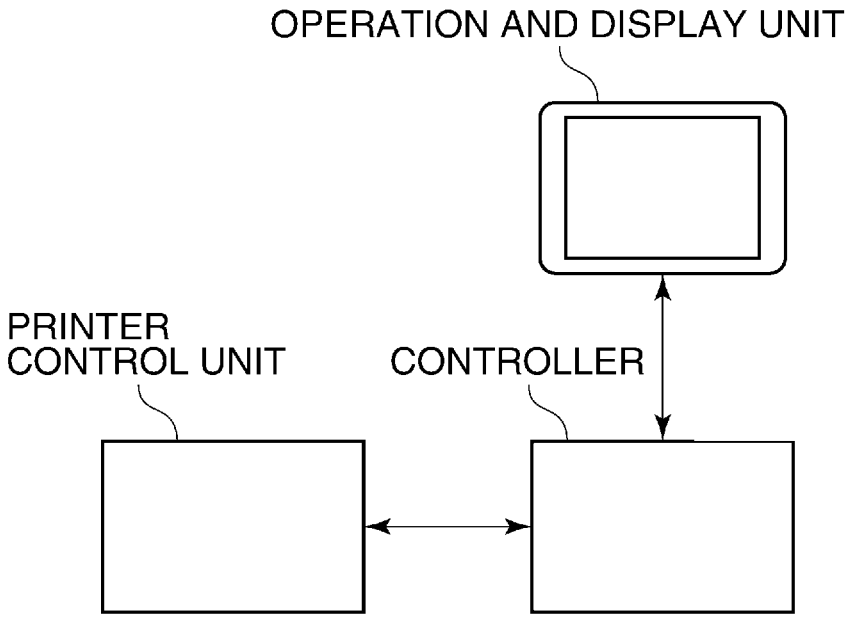
FIG. 16 is a diagram schematically showing arrangements of an operation unit, which registers sheet information, and a printer control unit according to the present invention.

This image forming apparatus has an operation/display unit as shown in FIG. 16, and when a user inputs sheet surface characteristics such as a sheet surface friction coefficient μ, a sheet size, a mass per unit area, and the presence or absence of a coating from the operation/display unit, data on the sheet surface characteristics is stored in the image control unit 7. In this case, the image control unit 7 acts as a surface characteristic determination unit. It should be noted that a storage area in which the information is stored is not limited to the image control unit 7, but for example, may be a storage area of a printer control unit, or a printer server.

When the sheet S with an image formed thereon is to be conveyed, the variable speed determination units 103R and 103L determine the target speeds Vs1 and Vs2 and amounts of toner used $D_R$ and $D_L$ in the regions 11R and 11L in the same way as described above. Also, based on the sheet surface friction coefficient μ and the amounts of toner used $D_R$ and $D_L$, the variable speed determination units 103R and 103L obtain respective friction coefficient correction values $\beta_R$ and $\beta_L$, from a table shown in FIG. 17. It should be noted that the sheet surface friction coefficient μ and the amounts of toner used $D_R$ and $D_L$ are each divided into four stages.

Based on the friction coefficient correction values $\beta_R$ and $\beta_L$, the variable speed determination units 103R and 103L obtain a correction value γ from a table shown in FIG. 18. It should be noted that the friction coefficient correction values $\beta_R$ and $\beta_L$, are each divided into six stages. Then, the variable speed determination unit 103R determines a target speed Vs5 using the target speed Vs1 and the correction value γ, and the variable speed determination unit 103L determines a target speed Vs6 using the target speed Vs2 and the correction value γ. The target speeds Vs5 and Vs6 are expressed by the following equations (3) and (4) where a predetermined correction adjustment value is Vd:

$$Vs5=Vs1+\gamma Vd \tag{3}$$

$$Vs6=Vs2-\gamma Vd \tag{4}$$

Here, Vd is an adjustment value for correcting for a difference between a computed correction result and an actual correction result, and correcting for subtle apparatus-to-apparatus variations such as mounting positions of sensors and drive rollers.

The variable speed determination units 103R and 103L send the determined target speeds to the respective motor pulse control units 120R and 120L. Based on the received target speeds, the motor pulse control units 120R and 120L control the rotational speeds of the respective skew correction roller pairs 2R and 2L.

Figure 19:
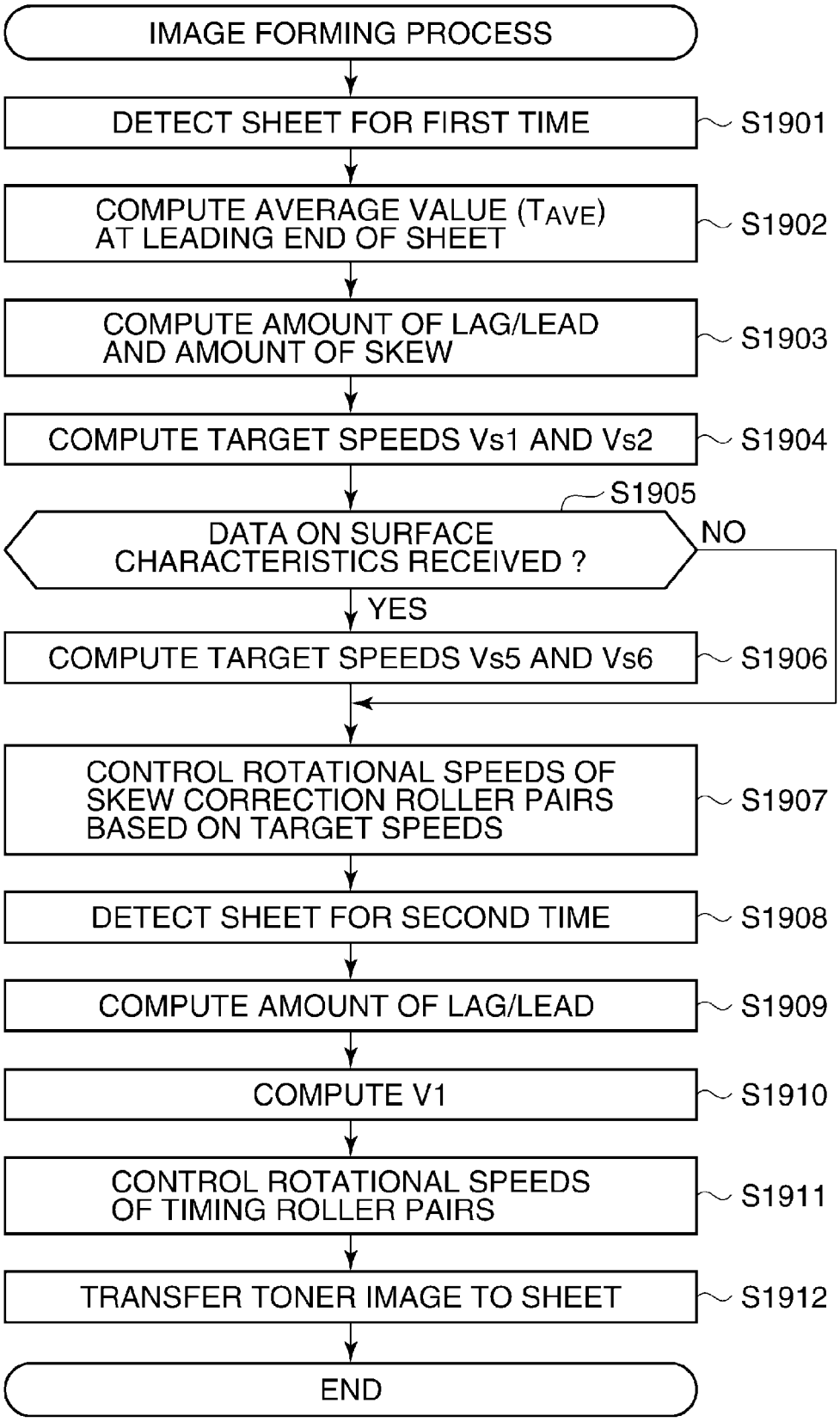
FIG. 19 is a flowchart of an image forming process carried out by an image forming apparatus according to the second embodiment.

Referring next to FIG. 19, a description will be given of an image forming process carried out by the image forming apparatus 500 according to a second embodiment.

FIG. 19 is a flowchart of the image forming process carried out by the image forming apparatus 500 according to the second embodiment. This process is basically the same as the image forming process according to the first embodiment. Thus, operations corresponding to those in FIG. 15 are designated by reference numerals of which last two digits are the same as those in FIG. 15 and description thereof is omitted, only different operations being described below.

Referring to FIG. 19, the variable speed determination units 103R and 103L determine whether or not they have received data on the amount of toner used from the image control unit 7 (S1905). When the variable speed determination units 103R and 103L have not received data on the amount of toner used from the image control unit 7, they send the determined target speeds Vs1 and Vs2 to the respective motor pulse control units 120R and 120L.

On the other hand, when the variable speed determination units 103R and 103L have received data on the amount of toner used from the image control unit 7, they determine the target speeds Vs5 and Vs6 based on the lag/lead amount, the skew amounts, and the data on surface characteristics (S1906), and send the determined target speeds Vs5 and Vs6 to the respective motor pulse control units 120R and 120L.

According to the first embodiment, when the sheet S having an image formed on the first surface thereof is conveyed so as to form an image on the second surface of the sheet S, skew and lagging/leading of the sheet S are corrected for with consideration given to a difference in the amount of slip due to a difference in the amount of toner used in regions where the respective skew correction roller pairs 1R and 1L and the sheet S contact on each other. Thus, skew during conveyance for image formation on the second surface can be reliably corrected for.

According to the second embodiment, when the sheet S having an image formed on the first surface thereof is conveyed so as to form an image on the second surface of the sheet S, skew and lagging/leading of the sheet S are corrected for with consideration given to a difference in the amount of slip due to a difference in the amount of toner used and a friction coefficient as sheet surface characteristics. Thus, as is the case with the first embodiment, skew during conveyance for image formation on the second surface can be reliably corrected for. Moreover, the sheet characteristics for use in determining the targets speeds Vs5 and Vs6 is not limited to a friction coefficient, but may be the presence or absence of a coating.

Moreover, although in the above described embodiments, the speed at which an image is transferred to the sheet S in the secondary transfer unit (transfer speed) is the steady-state speed V0, the transfer speed and the steady-state speed may not be equal. For example, it may be arranged such that the steady-state speed is set to be higher than the transfer speed and switched to the transfer speed by the timing roller pairs 1R and 1L correcting for lagging/leading of the sheet S and lowering the steady-state speed, and the sheet S is conveyed to the secondary transfer unit.

Moreover, in the above described embodiments, skew of the sheet S is corrected for using the skew correction roller pairs 2R and 2L to reduce the degree of lagging/leading of the sheet S to some extent, and then lagging/leading of the sheet S is reliably corrected for using the timing roller pairs 1R and 1L. In the above described embodiments, however, sheet skew and lagging/leading may be corrected for in parallel using, for example, the skew correction roller pairs 2R and 2L.

Moreover, in place of the sensors 6R and 6L that detect the leading end of the sheet S, a line sensor using a CCD (charge-coupled device) may be provided in a direction perpendicular to the sheet conveying direction so as to detect the leading end of the sheet S.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-231326 filed Oct. 5, 2009, which is hereby incorporated by reference herein in its entirety.

What is claimed is:

1. An image forming apparatus comprising:

a conveying unit configured to convey a sheet;

a plurality of conveying roller pairs provided in a direction intersecting a direction in which the sheet is conveyed, and configured to be driven independently of each other;

a skew amount detection unit configured to detect a skew amount of the sheet conveyed by said conveying unit;

a toner amount determination unit configured to determine a toner amount for an image formed on the sheet; and a control unit configured to correct for skew of the sheet by controlling driving speeds for said plurality of roller pairs independently of each other based on the skew amount detected by said skew amount detection unit and the toner amount determined by said toner amount determination unit.

2. An image forming apparatus according to claim 1, wherein said toner amount determining unit determines an amount of toner in regions where said plurality of roller pairs contact on the sheet.

3. An image forming apparatus according to claim 1, wherein said toner amount determining unit determines an amount of toner for an image formed on a first surface of the sheet, and said skew amount detection unit detects a skew amount of the sheet during conveyance for image formation on a second surface of the sheet.

4. An image forming apparatus according to claim 1, further comprising a surface characteristic determination unit configured to determine a surface characteristics of the sheet, wherein said control unit controls driving speeds for said plurality of roller pairs independently of each other based on the skew amount detected by said skew amount detection unit, the toner amount determined by said toner amount determination unit, and the surface characteristics determined by said surface characteristic determination unit.

5. An image forming apparatus that forms images on both surfaces of a sheet, comprising:

an image forming unit;

a conveying unit configured to convey the sheet to said image forming unit;

a correction unit comprising a plurality of roller pairs provided in a direction intersecting a direction in which the sheet is conveyed, and individually adjusting a speed at which the sheet is conveyed, and configured to correct for skew of the sheet conveyed by said conveying unit;

a skew amount detection unit configured to detect a skew amount of the sheet conveyed by said conveying unit;

a toner amount determination unit configured to determine an amount of toner for an image formed on a first surface of the sheet; and a control unit configured to, in conveying the sheet with the image formed on the first surface thereof to said image forming unit so as to form an image on a second surface of the sheet, control said correction unit based on the skew amount detected by said skew amount detection unit and the toner amount determined by said toner amount determination unit.

6. An image forming apparatus according to claim 5, wherein said control unit individually controls driving speeds for said plurality of roller pairs to correct for skew of the sheet based on the skew amount detected by said skew amount detection unit and the toner amount determined by said toner amount determination unit.

7. An image forming apparatus according to claim 6, wherein said toner amount determination unit determines the amount of toner in regions of the sheet conveyed by said conveying unit, which contact on said plurality of roller pairs.

8. An image forming apparatus according to claim 5, further comprising a surface characteristic determination unit configured to determine a surface characteristics of the sheet, wherein said control unit controls said correction unit based on the skew amount detected by said skew amount detection unit, the toner amount determined by said toner amount determination unit, and the surface characteristics of the sheet determined by said surface characteristic determination unit.

9. An image forming apparatus according to claim 8, wherein the surface characteristics of the sheet comprise a friction coefficient of the sheet.

10. A sheet conveying method for an image forming apparatus which has an image forming unit, a conveying unit that conveys a sheet, and a correction unit that has a plurality of roller pairs provided in a direction intersecting a direction in which the sheet is conveyed, and individually adjusting a speed at which the sheet is conveyed, and corrects for skew of the sheet conveyed by the conveying unit, and forms images on both surfaces of the sheet, comprising:

a skew amount detection step of detecting a skew amount of the conveyed sheet;

a toner amount determination step of determining a toner amount for an image formed on a first surface of the sheet; and a control step of, in conveying the sheet with the image formed on the first surface thereof to the image forming unit so as to form an image on a second surface of the sheet, controlling the correction unit based on the skew amount detected in said skew amount detection step and the toner amount determined in said toner amount determination step.

11. A sheet conveying method for an image forming apparatus which has a conveying unit that conveys a sheet, and a plurality of conveying roller pairs provided in a direction intersecting a direction in which the sheet is conveyed, and are driven independently of each other, comprising:

a skew amount detection step of detecting a skew amount of the sheet conveyed by the conveying unit;

a toner amount determination step of determining a toner amount for an image formed on the sheet; and a control step of correcting for skew of the sheet by controlling driving speeds for the plurality of roller pairs independently of each other based on the skew amount detected in said skew amount detection step and the toner amount determined in said toner amount determination step.

* * * * *